US011133160B2

(12) United States Patent
Holden et al.

(10) Patent No.: US 11,133,160 B2
(45) Date of Patent: Sep. 28, 2021

(54) DEVICES, SYSTEMS, AND METHODS FOR DISSOCIATION OF IONS USING LIGHT EMITTING DIODES

(71) Applicants: THERMO FINNIGAN LLC, San Jose, CA (US); THERMO FISHER SCIENTIFIC (BREMEN) GMBH, Bremen (DE); BOARD OF REGENTS, THE UNIVERSITY OF TEXAS SYSTEM, Austin, TX (US)

(72) Inventors: Dustin D. Holden, Austin, TX (US); Jens Griep-Raming, Bremen (DE); Alexander A. Makarov, Bremen (DE); Jennifer S. Brodbelt, Austin, TX (US); Yevgeniy Zhuk, San Jose, CA (US); Jae C. Schwartz, San Jose, CA (US)

(73) Assignees: BOARD OF REGENTS, UNIVERSITY OF TEXAS SYSTEM, Austin, TX (US); THERMO FISHER SCIENTIFIC (BREMEN) GMBH, Bremen (DE); THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/306,238

(22) PCT Filed: Jun. 2, 2017

(86) PCT No.: PCT/US2017/035689

§ 371 (c)(1),
(2) Date: Nov. 30, 2018

(87) PCT Pub. No.: WO2017/210560

PCT Pub. Date: Dec. 7, 2017

(65) Prior Publication Data

US 2019/0295831 A1 Sep. 26, 2019

Related U.S. Application Data

(60) Provisional application No. 62/345,546, filed on Jun. 3, 2016.

(51) Int. Cl.
*H01J 49/00* (2006.01)
*H01J 49/02* (2006.01)
*H01J 49/14* (2006.01)

(52) U.S. Cl.
CPC ..... *H01J 49/0059* (2013.01); *H01J 49/0068* (2013.01); *H01J 49/022* (2013.01); *H01J 49/14* (2013.01)

(58) Field of Classification Search
None
See application file for complete search history.

(56) References Cited

U.S. PATENT DOCUMENTS 6,919,562 B1 7/2005 Whitehouse
7,947,948 B2 5/2011 Schwartz
(Continued)

FOREIGN PATENT DOCUMENTS

GB 2389704 A 12/2003
GB 2502155 B * 5/2020 ..... H01J 49/36
(Continued)

OTHER PUBLICATIONS

International Preliminary Report on Patentability and Written Opinion issued in Application No. PCT/US2017/035689 dated Dec. 4, 2018.

(Continued)

*Primary Examiner* — James Choi
(74) *Attorney, Agent, or Firm* — Jones Robb, PLLC

(57) ABSTRACT

Systems, methods, and devices to dissociate ions using one or more light emitting diodes (LEDs). A mass spectrometer for ion dissociation includes an ion source for providing ions (Continued)

for dissociation, a mass analyzer, and a photodissociation (PD) device. The PD device includes an ion transport device. The ion transport device is configured perform one or more of: transporting the ions through the PD device, and trapping the ions within a region of the PD device. The PD device also includes one or more LEDs positioned to irradiate the ions in the PD device, resulting in fragmentation of the ions.

26 Claims, 24 Drawing Sheets

(56) References Cited

U.S. PATENT DOCUMENTS

| | | | | |
|---|---|---|---|---|
| 8,278,619 | B2 | 10/2012 | Makarov et al. | |
| 8,957,369 | B2 | 2/2015 | Makarov | |
| 9,123,517 | B2 * | 9/2015 | Papanastasiou | H01J 49/36 |
| 9,209,005 | B2 | 12/2015 | Makarov | |
| 9,245,723 | B2 | 1/2016 | Makarov et al. | |
| 2005/0127289 | A1 * | 6/2005 | Fuhrer | H01J 49/025 250/288 |
| 2009/0134321 | A1 * | 5/2009 | Hoyes | H01J 49/004 250/282 |
| 2010/0019144 | A1 | 1/2010 | Schwartz et al. | |
| 2010/0065733 | A1 * | 3/2010 | Bateman | G01N 27/622 250/282 |
| 2010/0123075 | A1 * | 5/2010 | Dantus | H01J 49/0059 250/282 |
| 2010/0207023 | A1 * | 8/2010 | Loboda | H01J 49/0059 250/282 |
| 2013/0020481 | A1 | 1/2013 | Makarov et al. | |
| 2015/0364302 | A1 | 12/2015 | Oleg et al. | |
| 2018/0174815 | A1 * | 6/2018 | Bossmeyer | H01J 49/0031 |
| 2019/0265195 | A1 * | 8/2019 | Park | H01J 49/0031 |

FOREIGN PATENT DOCUMENTS

| | | | |
|---|---|---|---|
| WO | 2006103412 | A2 | 10/2006 |
| WO | 2007010272 | A2 | 1/2007 |
| WO | 2017210560 | A1 | 12/2017 |

OTHER PUBLICATIONS

Olsen et al., "Higher-energy C-trap dissociation for peptide modification analysis", Nature Methods, vol. 4, No. 9, Sep. 2007.

J. Brodbelt, "Photodissociation mass spectrometry: new tools for characterization of biological molecules", Chem. Soc. Rev., 2014, 43, pp. 2757-2783.

Shaw et al., "Complete Protein Characterization Using Top-Down Mass Spectrometry and Ultraviolet Photodissociation", J. Am. Chem. Soc. 2013, 135, pp. 12646-12651.

Cannon, et al., "Top-Down 193-nm Ultraviolet Photodissociation Mass Spectrometry for Simultaneous Determination of Polyubiquitin Chain Length and Topology", Anal. Chem. 2015, 87, pp. 1812-1820.

Cannon et al., "Hybridizing Ultraviolet Photodissociation with Electron Transfer Dissociation for Intact Protein Characterization", Anal. Chem. 2014, 86, pp. 10970-10977.

Holden et al., "Ultraviolet Photodissociation Induced by Light-Emitting Diodes in a Planar Ion Trap", Angew. Chem 2016, 128, pp. 12605-12609.

Supplemental Information for the Holden et al. article, 2016, S1-S10.

International Search Report issued in Application No. PCT/US2017/035689 dated Aug. 25, 2017.

* cited by examiner

DEVICES, SYSTEMS, AND METHODS FOR DISSOCIATION OF IONS USING LIGHT EMITTING DIODES

CROSS-REFERENCE TO RELATED APPLICATIONS

This application claims the benefit of U.S. Provisional Application No. 62/345,546, filed Jun. 3, 2016, the entire contents of which are incorporated herein.

STATEMENT REGARDING FEDERALLY SPONSORED RESEARCH

This invention was made with government support under research grant CHE 1402753 awarded by National Science Foundation. The government has certain rights in the invention

INTRODUCTION

Mass spectrometry is an analytical method used to identify compounds based on their molecular weight and fragmentation pattern, which provides a molecular fingerprint. Lasers can be used to produce photons and irradiate the ions, causing the ions to fragment in a process called photodissociation (PD). Depending on the operational wavelength of the laser, ultraviolet PD (UVPD) and infrared multiphoton PD (IRMPD) processes can be used to dissociate the ions. Mass spectrometry uses lasers that are normally positioned outside of the vacuum chamber of the mass spectrometer. The location of the laser typically requires special optics and flanges to guide photons into the irradiation area during conventional UVPD of gas-phase ions.

Because of the optics and flanges, the lasers may need to be aligned, and in many cases collimated or otherwise focused, to restrict the laser beam to a prescribed path in the mass spectrometer and to minimize damage to other components. Additionally, lasers require an optical port and optical access to the ion population (often constrained in a trapping cell within a vacuum chamber), and optical components such as lenses must be integrated in a manner that is stable to facilitate alignment and overlap of the laser generated radiation with the ion population.

Also, because a laser produces collimated light with minimal divergence, the resulting laser beam is typically arranged to align with the central axis of an ion beam or trapped ions in order to obtain the highest overlap between ions and photons. Other orientations of the laser beam require extra precision in timing and optimization to obtain an overlap with ions passing through the laser beam. Additionally, lasers are costly and may require auxiliary gases and/or cooling units and associated plumbing to operate effectively. Moreover, the structural magnitude, configuration complexity, and expense of a monochromatic laser may present technical challenges to pursuing ion processing strategies that involve the irradiation of ions with radiation at multiple wavelengths.

Therefore, a need exists for a PD device, and related systems and methods, that can take advantage of the versatile applications of PD and overcome the associated challenges of laser-based designs.

Overview

Examples of embodiments described herein include systems, methods, and devices for disassociating ions. In one example, a mass spectrometer for ion dissociation includes an ion source for providing ions for dissociation, a mass analyzer, and a photodissociation (PD) device. The PD device includes an ion transport device. The ion transport device is configured perform one or more of: transporting the ions through the PD device, and trapping the ions within a region of the PD device. The PD device also includes one or more light emitting diodes (LEDs) positioned to irradiate the ions in the PD device, resulting in fragmentation of the ions.

In another example, a photodissociation (PD) device for use in a mass spectrometer includes an ion transport device. The ion transport device is configured perform one or more of: transporting ions into the PD device, transporting the ions within the PD device, transporting the ions to a mass analyzer of the mass spectrometer, and trapping the ions within a region of the PD device. The PD device also includes one or more light emitting diodes (LEDs) positioned to irradiate the ions in the PD device, resulting in fragmentation of the ions.

In another example, a method of dissociating ions in a mass spectrometer includes transporting ions to a first region of a photodissociation (PD) device. The method also includes performing a first dissociation technique on the ions. The method further includes transporting the ions from the first region to a second region of the PD device. The method also includes irradiating the ions in the second region using one or more light emitting diodes (LEDs), resulting in fragmentation of the ions.

BRIEF DESCRIPTION OF THE DRAWINGS

FIGS. 2A 1-4 depict a process of transporting and trapping ions in the PD device, according to exemplary embodiments.

Figure 1A:
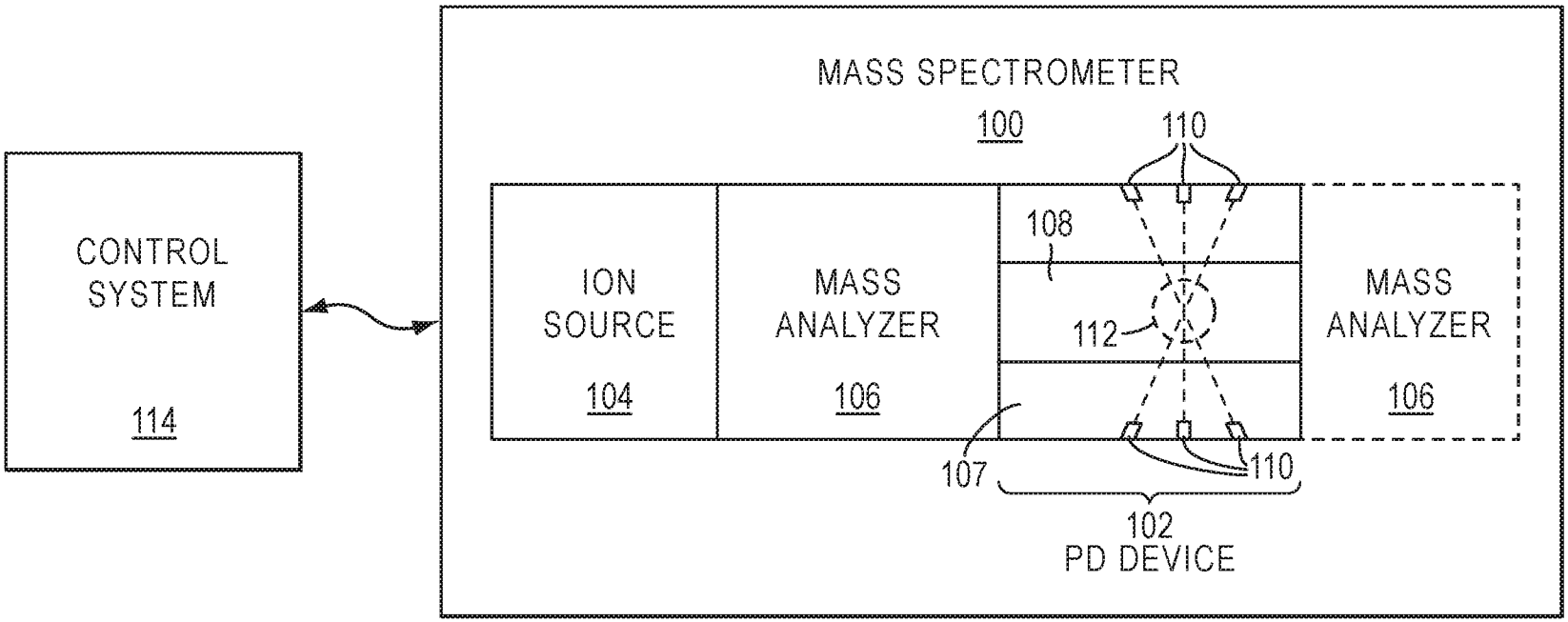
FIGS. 1A, 1B, and 1C schematically depict a mass spectrometer including a photodissociation (PD) device for disassociating or fragmenting ions, according to exemplary embodiments of the present disclosure.

Although the following detailed description makes reference to exemplary illustrative embodiments, many alternatives, modifications, and variations thereof will be apparent to those skilled in the art and are contemplated as within the scope of the present disclosure and claims. Accordingly, it is intended that the claimed subject matter is provided its full breadth of scope and to encompass equivalents.

DETAILED DESCRIPTION

In exemplary embodiments of the present disclosure, systems, methods, and devices relate to a photodissociation (PD) device that utilizes light emitting diodes (LEDs), which can be used in mass spectroscopy. According to embodiments, a PD device with LEDS can be incorporated into a vacuum chamber of a mass spectrometer to perform dissociation of gas-phase ions. The LEDs are positioned or implanted in a chamber of the PD device of a mass spectrometer to allow a convenient mechanism by which to irradiate ions with photons to cause the ions to dissociate. The resulting fragmentation patterns are used to identify molecules and serve as a molecular fingerprint. Various dissociation techniques may be utilized or combined in a single device, including PD, UVPD, electron-transfer dissociation (ETD), electron-capture dissociation (ECD), collision induced dissociation (CID), and/or high-energy collision dissociation (HCD). Additionally, according to embodiments, the PD device is capable of moving ions into and out of the path of radiation emanating from LEDs to precisely control when dissociation occurs and to what extent. The LEDs can be ultraviolet LEDs, visible light LEDs, or infrared LEDs.

Because LEDs offer a relatively inexpensive, safe, and robust way to generate photons, the PD device incorporating the LEDs eliminates the need for a costly, relatively complex laser that can pose safety concerns. Additionally, LEDs are small light sources that can be positioned inside the mass spectrometer and alleviate the safety concerns of using external lasers to generate photons. Also, optimizing the position of gas-phase ions and increasing the concentration of the photons emitting from each LED into an area of high or highest intersection increases the efficiency of the system.

Additionally, because the PD device can utilize any current and future wavelength available from LEDs, including organic light emitting diodes (OLEDs), the PD device also can be applied to the dissociation of any small gas-phase ion undergoing mass spectrometry analysis not exclusive to but including, plasticizers, pharmaceuticals and compounds related to materials chemistry research. Also, depending on the wavelength and power output qualities, LEDs may be used for mass spectrometry analysis for a wide range of omics applications and gas-phase spectroscopy research. For example, due to its high energy deposition which results in the production of rich fragmentation patterns, UVPD has emerged as a powerful alternative type of ion processing method for characterization of molecules ranging from small molecules to peptides to nucleic acids to lipids to proteins.

Figure 1B:
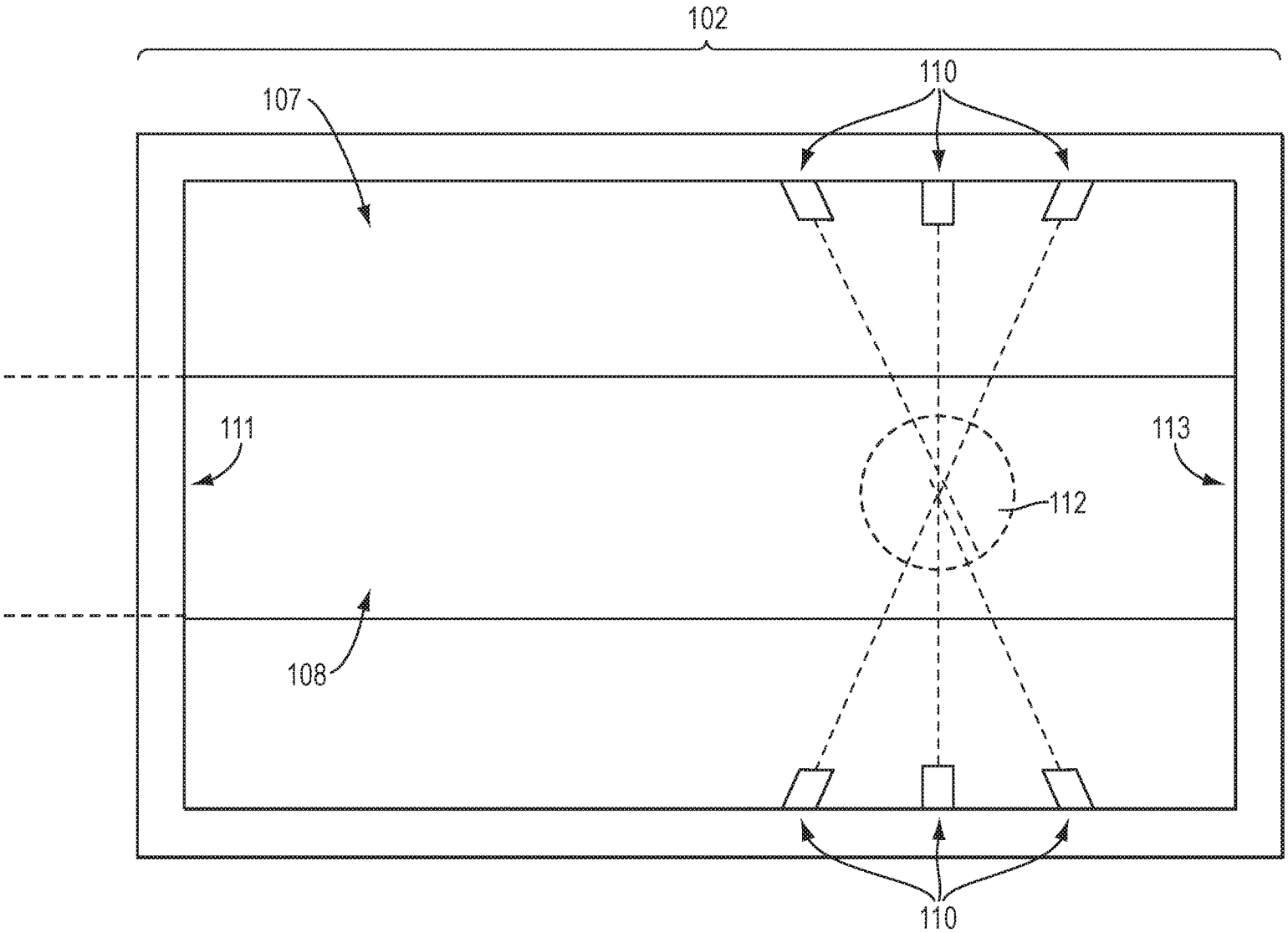

FIGS. 1A and 1B depict an exemplary embodiment of a mass spectrometer 100 including a photodissociation (PD) device 102 for dissociating or fragmenting ions. While FIGS. 1A and 1B illustrate various components contained in the mass spectrometer 100, FIGS. 1A and 1B are exemplary and additional components can be added and existing components can be removed. Additionally, other components of the mass spectrometer 100 not relating to the PD device 102 have been omitted for clarity.

As illustrated in FIG. 1A, the mass spectrometer 100 includes an ion source 104 and at least one mass analyzer 106 coupled to the PD device 102. The ion source 104 can be configured to provide a source of ions for dissociation or fragmentation by the PD device 102 and mass analysis by the mass analyzer 106 and a detector. The mass analyzer 106 can be any type of mass spectroscopy analyzer, such as an OrbiTrap, quadrupole, ion trap, time of flight, or combinations of mass analyzers. The PD device 102 can be integrated within a vacuum chamber of the mass spectrometer 100 and can be combined with other ion dissociation techniques. Additionally, in an exemplary embodiment, the PD device 102 can be removable and designed to be installed into existing mass spectrometers 100.

The mass analyzer 106 can be placed adjacent to the PD device 102 to analyze the ions after dissociation or fragmentation by the PD device 102. For example, the mass analyzer 106 can be positioned between the ion source 104 and the PD device 102. In this configuration, the ions from the ion source 104 can be transported into the PD device 102. After the PD process, the ions can be transported back out of the PD device 102 into the mass analyzer 106. In another exemplary arrangement, the mass analyzer 106 can be positioned adjacent to the PD device 102 opposite the ion source 104. In this configuration, the ions from the ion source 104 can be transported into the mass analyzer 106 from the ion source 104. During the PD process, the ions can flow through the PD device 102 and into the mass analyzer 106.

FIG. 1B illustrates a more detailed cross-section view of the PD device 102. The PD device 102 is constructed of an enclosure or chamber 107. The chamber 107 can be constructed to maintain a relatively gas-tight enclosure so that desired pressure and gaseous species can be contained within the chamber 107.

The chamber 107 includes an ion transport or containment device 108 and one or more light emitting diodes (LEDs) 110. The ion transport or containment device 108 is configured to transport or contain the ions, from the ion source 104 into the chamber 107, through an entry 111, to an irradiation region 112 inside the PD device 102. The LEDs 110 are positioned to direct radiation at the radiation region 112 so that the radiation, from the LEDs 110, converge at the radiation region 112.

The ion transport or containment device 108 can be constructed to connect to the entry 111 and positioned to travel the longitudinal length of the chamber 107. In some embodiments, the ion transport or containment device 108 can be contained within the chamber 107. In some embodiments, the ion transport or containment device 108 can extend outside of the chamber 107, for example, through the entry 111 and/or through an exit 113.

The ion transport or containment device 108 can be configured to transport ions from the ion source 104 into, out of, or contain within the chamber for irradiation by the LEDs 110. For example, in some embodiments, the ion transport or containment device 108 can be configured to transport the ions to the irradiation region 112 and hold, compress, or trap the ions at one or more localized regions in the chamber 107, for instance, the irradiation region 112, to facilitate the dissociation or fragmentation of the ions. Likewise, for example, in some embodiments, the ion transport or containment device 108 can be configured to flow the ions through the irradiation region 112 at a velocity that allows the dissociation or fragmentation of the ions.

The ion transport or containment device 108 is constructed of electrical components that generate electromagnetic fields along the longitudinal length of the ion transport device. The ion transport or containment device 108 can be configured to include voltages and potentials along the longitudinal length of the ion transport or containment device 108 in order transport and trap the ions. The ion transport or containment device 108 can be configured to include potential gradients along the longitudinal length of the ion transport or containment device 108 to control the velocity (i.e., speed and direction) of the ions within the chamber 107.

Figure 1C:
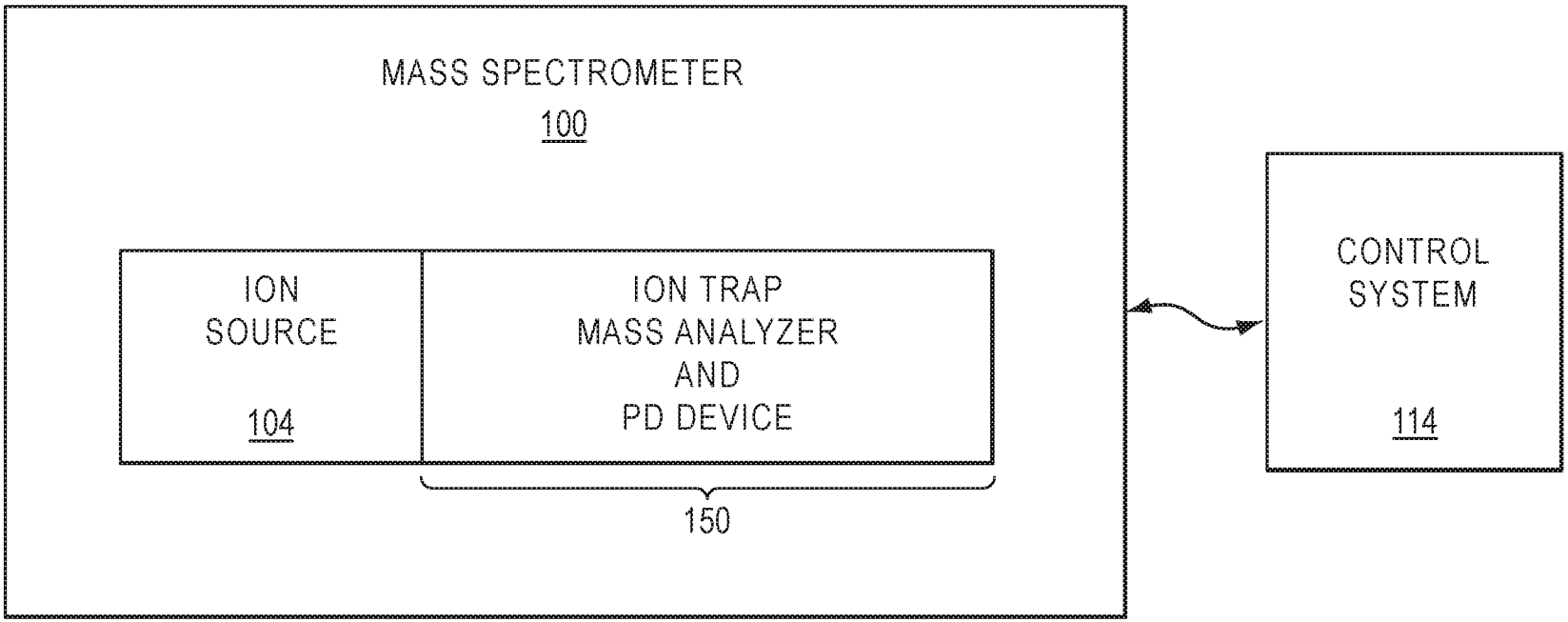

FIG. 1C depicts another exemplary embodiment of a mass spectrometer 100 including an ion trap mass analyzer and PD device 150, contained within a single unit and/or integrated into a common structure, for dissociating or fragmenting ions. The ion trap mass analyzer may take the form of a two-dimensional ion trap mass analyzer or a three-dimensional ion trap mass analyzer. While FIG. 1C illustrates various components contained in the mass spectrometer 100, FIG. 1C is exemplary and additional components can be added and existing components can be removed. Additionally, other components of the mass spectrometer 100 not relating to the PD device 150 have been omitted for clarity.

As illustrated in FIG. 1C, the mass spectrometer 100 can include an ion source 104 that is coupled to the ion trap mass analyzer and PD device 150. The ion trap mass analyzer and PD device 150 can include components of a PD device as discussed above with reference PD device 102. In addition, the ion trap mass analyzer and PD device 150 can include an ion trap mass analyzer incorporated into the PD device. The ion trap mass analyzer can include components to perform mass analysis of ions.

In any of the exemplary embodiments, the mass spectrometer 100 can include one or more additional dissociation systems. The dissociation systems can be configured to work in cooperation with the PD device to dissociation ions. For example, the dissociation systems can be configured to perform dissociation techniques such as ultraviolet photodissociation (UVPD), infrared multiphoton photo dissociation (IRMPD), electron-transfer dissociation (ETD), electron-capture dissociation (ECD), collision induced dissociation (CID), and high-energy collision dissociation (HCD). As such, the additional dissociation systems can include any necessary hardware, software, and combination thereof to perform the dissociation techniques. The additional dissociation systems can be incorporated in the mass spectrometer 100, incorporated in the PD device 102 or 150, and combination thereof.

Figure 2A:
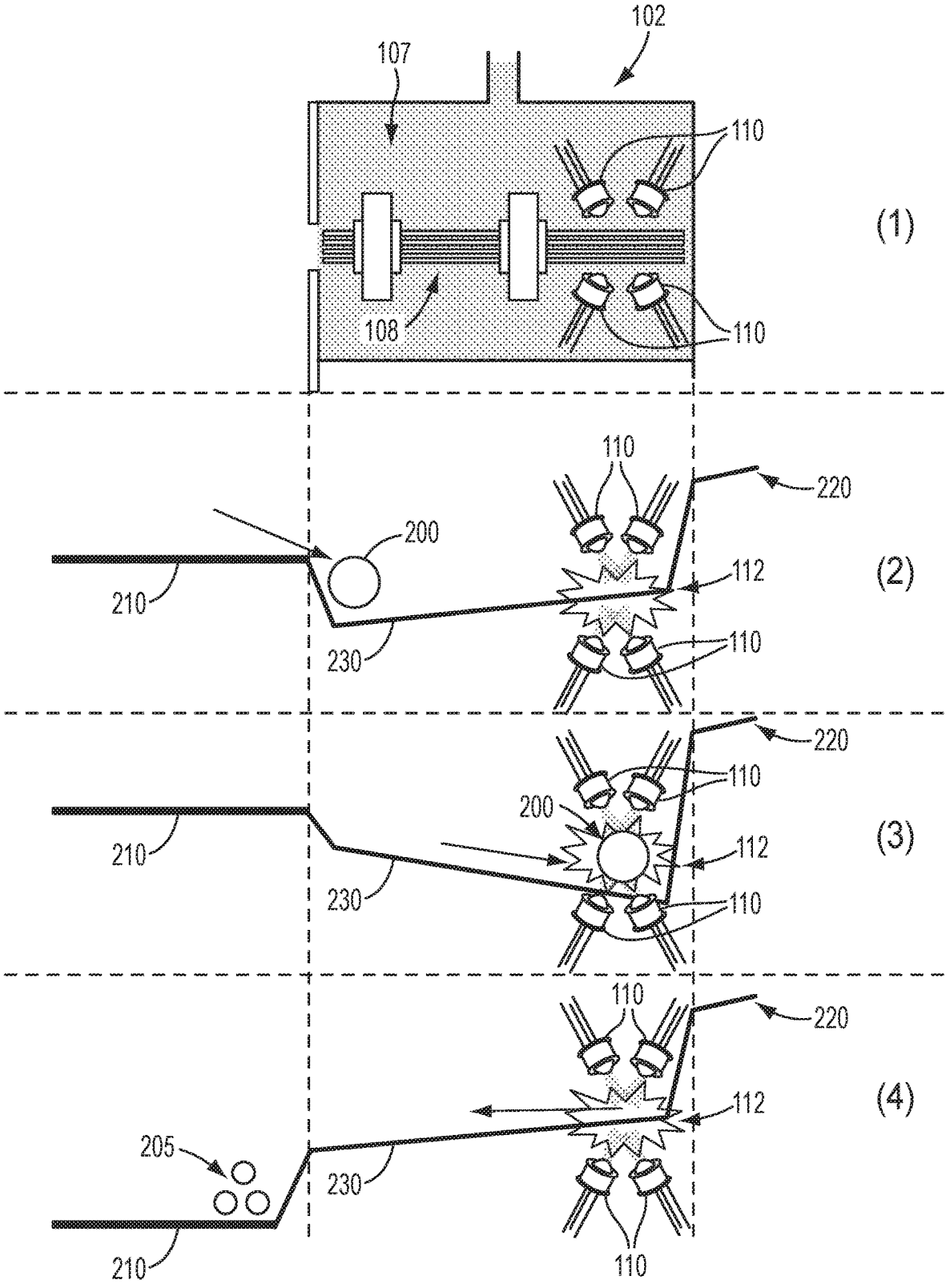
Figure 2B:
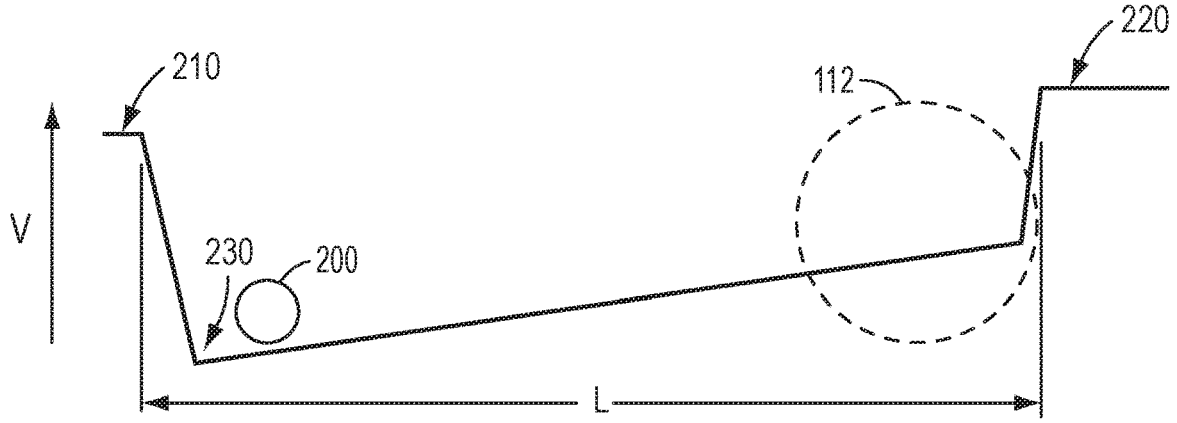
FIGS. 2B-2D depict an electromagnetic field potential along a longitudinal direction of the PD device, according to exemplary embodiments of the present disclosure.
Figure 2C:
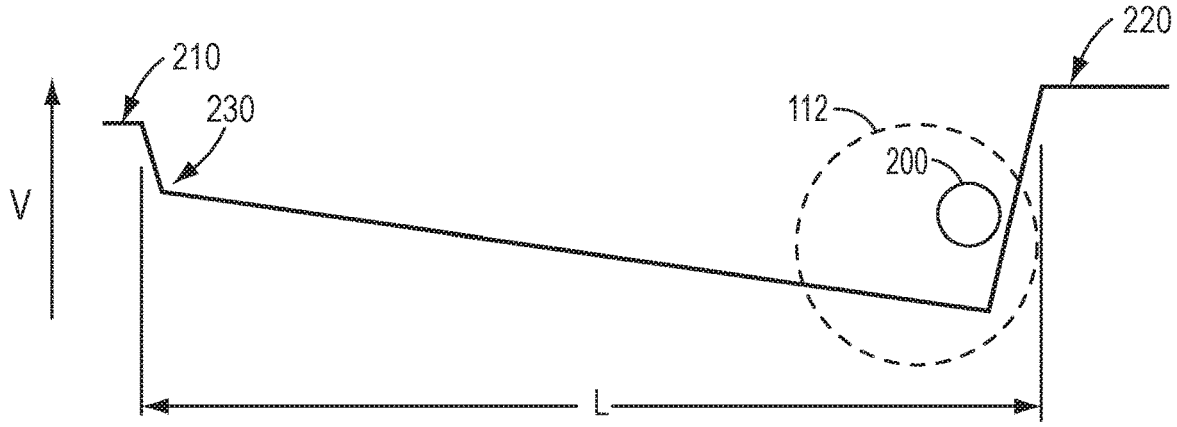

FIGS. 2A-2C illustrate exemplary electromagnetic field potential profiles along a longitudinal direction of the ion transport or containment device 108. For reference, the longitudinal length L of FIGS. 2A-2C can represent the approximate longitudinal length of the ion transport or containment device 108. In some embodiments, the longitudinal length L can be approximately the longitudinal length of the PD device 102. In other embodiments, the longitudinal length L can extend beyond the confines of the PD device 102. Thus, the length represented by longitudinal length L and potentials illustrated are intended to represent the relative potentials along the longitudinal length of the ion transport or containment device 108.

Figure 2D:
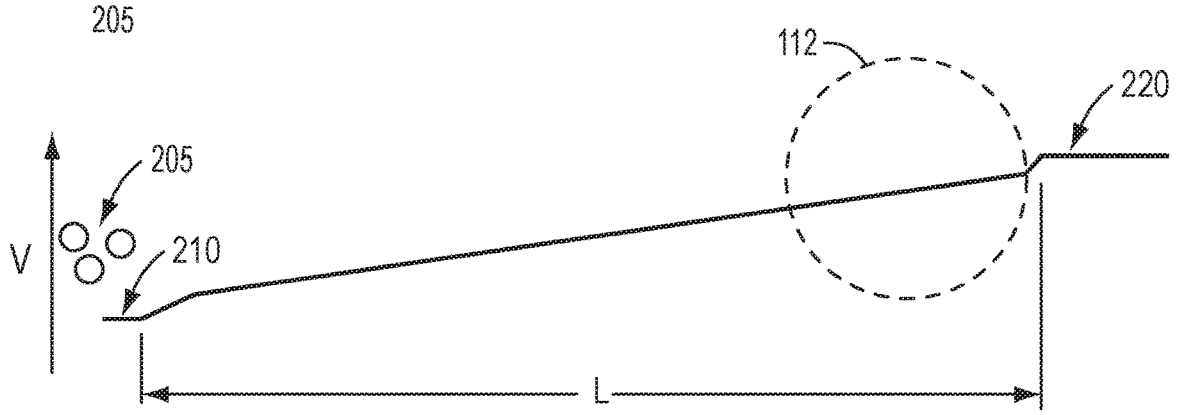

FIG. 2A shows the process of transporting and irradiating ions using PD device 102. FIGS. 2B-2D show an electric potential, V, along the longitudinal length L of the ion transport or containment device 108 during a process of transporting and trapping ions at a location within the chamber 107. For example, the location can correspond to the irradiation region 112 (FIG. 2C) or another location away from the irradiation region 112 (FIG. 2B). As illustrated in FIG. 2A-2 and FIG. 2B, the electrical potential at a front region 210 and a back region 220 along the longitudinal length of the ion transport or containment device 108 is set and maintained at a higher level relative to a region 230 that is between the front region 210 and the back region 220 along the longitudinal length of ion transport or containment device 108 to assure one or more ions 200 are contained within the transport or containment device 108. As illustrated in FIG. 2B, in the region 230, within the chamber 107, the potential is set and maintained at a lower level relative to the front region 210 and back region 220, such that potential barriers are formed. The potential in region 230 has a gradient of increasing potential from the front region 210 to the back region 220. Ions 200 enter the chamber from the front region 210, become trapped toward the front end of the chamber 107. The slope of the potential gradient in cell region 230 can be at any level to trap the ions in the region 230. For example, the slope of the potential gradient can range from −0.1 Volts/millimeter (V/mm) to about −0.5 V/mm.

FIG. 2A-3 shows the process of transporting ions to an irradiation region 112, and FIG. 2C shows an electric potential, V, along the longitudinal length L of the ion transport or containment device 108 during a process of transferring selected ions 200 from the region 230 to the irradiation region 112. In this process, the slope of the potential gradient between the region 230 and the irradiation region 112 is inverted, such that a gradient of decreasing potential is formed between the front region 210 the irradiation location 112. For example, the slope of the potential gradient can range from −0.1 Volts/millimeter (V/mm) to about −0.5 V/mm By this process, the ions in the chamber 107 can be trapped for a period of time at the irradiation region 112 for irradiation by one or more of the LEDs 110. For example, the period of time can be a predetermined time period that corresponds with irradiation time required to disassociate or fragment the ions. In various exemplary embodiments, the period of time for irradiation can depend on the ions being irradiated, the parameters of the LEDs (wavelength, power, etc.), and the like.

FIG. 2A-4 shows the process of transporting ions after irradiation, and FIG. 2D shows an electric potential, V, along the longitudinal length L of the ion transport or containment device 108 during a process of transporting ions out of the chamber 107, for example, to the mass analyzer 106. To transport ions 205, which have been irradiated, the potential at the front region 210 is decreased and the potential in the back region 220 is increased to create a potential gradient between the front region 210 and back 220 such that the ions move towards the front region 210 and out of the PD device 102.

The LEDs 110 can be any type of LED that emits radiation at wavelengths ranging from infrared (IR) to ultraviolet (UV) in order to disassociate or fragment the ions from the ion source 104. In some embodiments, for example, one or more of the LEDs 110 can emit radiation in wavelengths ranging from about 10 nm to about 950 nm. In some embodiments, one or more of the LEDs 110 can emit radiation in a wavelength ranging from about 10 nm to about 380 nm (i.e., UV radiation). In some embodiments, one or more of the LEDs 110 can emit radiation in a wavelength ranging from about 255 nm to about 275 nm, for instance, about 255 nm, about 265 nm, and/or about 275 nm.

In some embodiments, one or more of the LEDs 110 can be configured to emit radiation in a different wavelength from other LEDs 110. For example, one or more of the LEDs 110 can emit IR radiation, one or more of the LEDs 110 can emit visible radiation, and/or one or more of the LEDs 110 can emit UV radiation. By using multiple wavelengths, the PD device 102 can perform ion dissociation processes that involve the irradiation of ions with radiation at multiple wavelengths.

In some embodiments, the LEDs 110 can include one or more lenses for focusing or spreading the light on the ions. In some embodiments, AC current can be applied to the LEDs 110 to produce pulsed light. In some embodiments, DC current can be applied to the LEDs 110 to produce a continuous beam of light. The continuous beam of light from the LEDs can be used, for example, where the ions flow through an ion guide without trapping. In some embodiments, LEDs 110 irradiation times can be adjusted—e.g. extended or increased—to regulate MS/MS efficiencies and the extent of ion fragmentation.

In embodiments, the LEDs 110 can be coupled to the walls of the chamber 107 and directed at the irradiation region 112. In some embodiments, for example, the LEDs 110 can be fixed to the walls of the chamber 107. In some embodiments, for example, the LEDs 110 can be movably coupled to walls of the chamber 107 to allow the LEDs 110 to be repositioned, manually, automatically, or combination thereof. For instance, the LEDs 110 can be coupled to the walls of the chamber 107 by gimbals, swivels, motors, and the like.

Figure 3A:
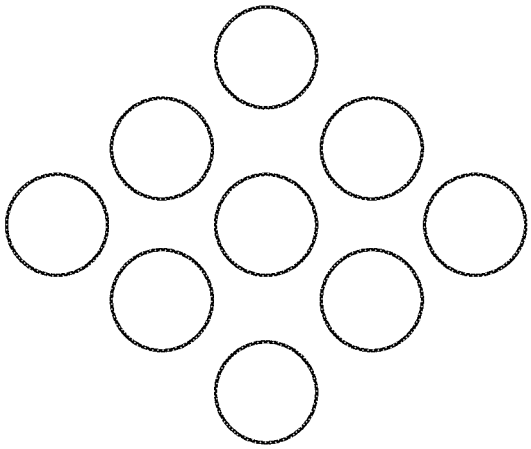
FIGS. 3A and 3B depict exemplary configurations of a single LED that includes multiple radiation sources, according to embodiments of the present disclosure.
Figure 3B:
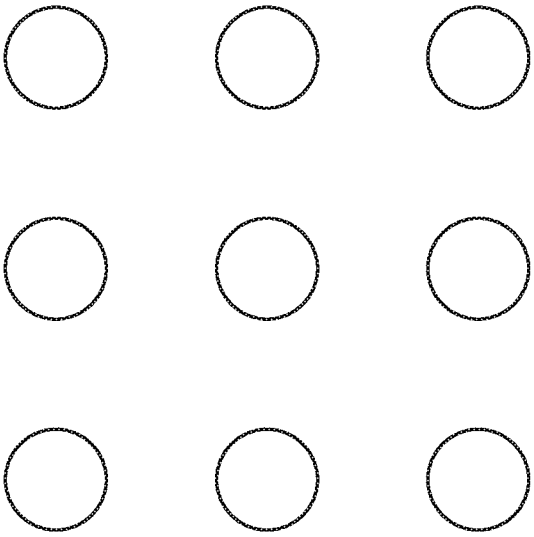

In some embodiments, a single LED 110 can be configured to include a single source of radiation. In some embodiment, a single LED 110 can be configured to include multiple sources of radiation. For example, a single LED 110 can include multiple radiation sources that each emits the same type of radiation, different types of radiation, or combination thereof. FIGS. 3A and 3B illustrate examples of a configuration of a single LED 110 that includes multiple radiation sources.

Referring again to FIG. 1A, the mass spectrometer 100 is coupled to a control system 114. The control system 114 can include hardware, software, and combinations thereof to control the mass spectrometer 100 and perform the PD processes described herein. For example, the control system 114 can be configured to control the ion transport or containment device 108 (e.g., the electrical potentials) to transport the ions. Likewise, for example, the control system 114 can be configured to control the operation of the LEDs 110, such as, emission of the radiation (e.g., timing, duration, etc.), positioning/direction of the LEDs 110, and the like. The control system 114 can be one or more standalone systems, one or more components of the mass spectrometer 100, or combination thereof.

FIGS. 4A-4F depict various views of an exemplary embodiment of a PD device 400 that can be used in a mass spectrometer, for example, the PD device 102 in the mass spectrometer 100. While FIGS. 4A-4F illustrate various components contained in the PD device 400, FIGS. 4A-4F illustrate one embodiment of a PD device and additional components can be added and existing components can be removed.

Figure 4A:
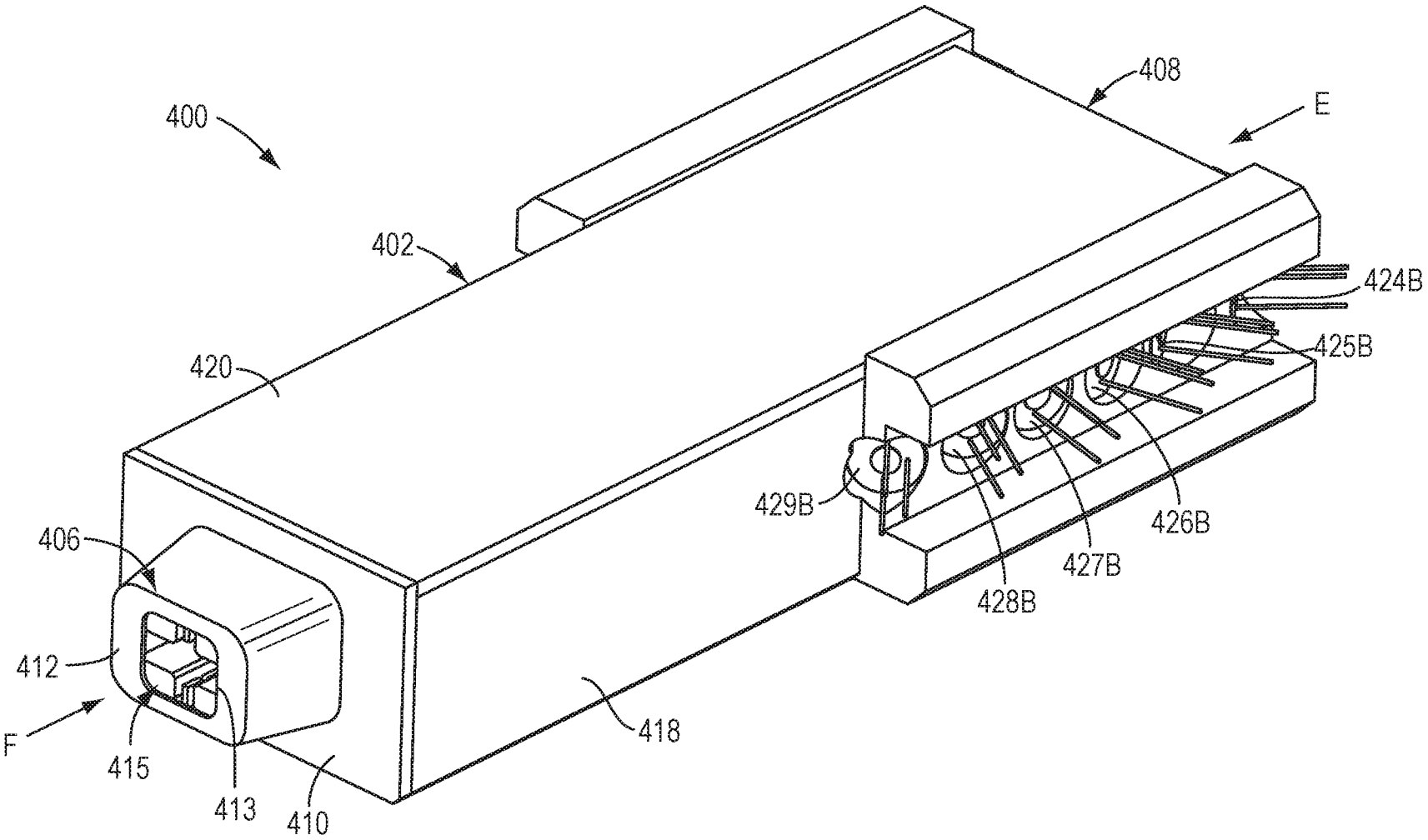
FIG. 4A is a perspective view of a PD device for use with a mass spectrometer according to an exemplary embodiment of the present disclosure.
Figure 4B:
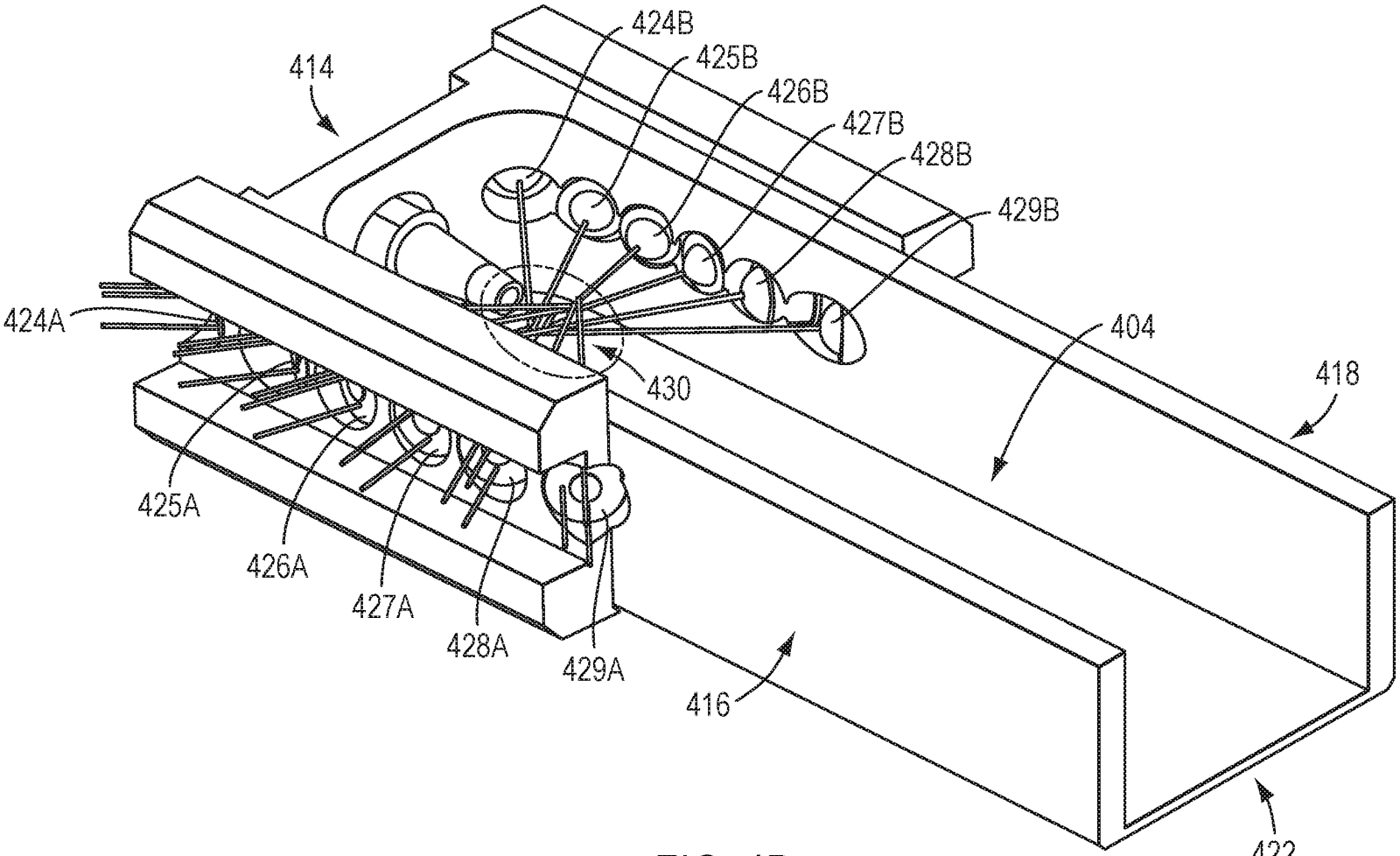
FIG. 4B is a perspective interior view of the PD device of FIG. 4A.

As shown in FIGS. 4A and 4B, the PD device 400 comprises a chamber housing 402 defining a chamber 404 (see FIG. 4B with ion transport device removed) with a first end 406 and a second end 408 opposite the first end 406. The chamber housing 402 also comprises a front end wall 410 from which a front piece 412 extends outwardly and defines an entry 413 to introduce ions into the chamber interior 404 by an ion transport device 415, a back end wall 414 (obscured from view in FIG. 4A; see FIG. 4B), a first lateral side 416 (obscured from view in FIG. 4A; see FIG. 4B), a second lateral side wall 418, a top sidewall 420, and a bottom sidewall 422 (obscured from view in FIG. 4A; see FIG. 4B). The chamber housing 402 forms a relatively gas-tight enclosure so that desired pressure and gaseous species may be maintained in the chamber 404. In operation, ions selected for processing are delivered through the entry 413 to the chamber 404 by the ion transport device 415. The ions are then subjected to one or more of the PD processes in accordance embodiments of the present disclosure. After processing, the processed ions are transmitted, by the ion transport device 415, out of the chamber housing 402 through either the entry 413 through which they were introduced or an optionally included exit located at the second end 414 (back) of the chamber housing 402 for further processing and/or analysis.

The PD device 400 further includes a plurality of LEDs. As shown, the plurality of LEDs can include a first pair of LEDs 424A and 424B, a second pair of LEDs 425A and 425B, a third pair of LEDs 426A and 426B, a fourth pair of LEDs 427A and 427B, a fifth pair of LEDs 428A and 428B, and a sixth pair of LEDs 429A and 429B. The plurality of LEDs can be positioned near the back end wall 414. The plurality of LEDs can be integrated within opposite lateral sidewalls 416, 418 of the chamber housing 402. In some embodiments, the plurality of LEDs can be integrated within the lateral sidewalls 416, 418. In some embodiments, the plurality of LEDs can be moveable coupled to the lateral sidewalls 416, 418.

Figure 4C:
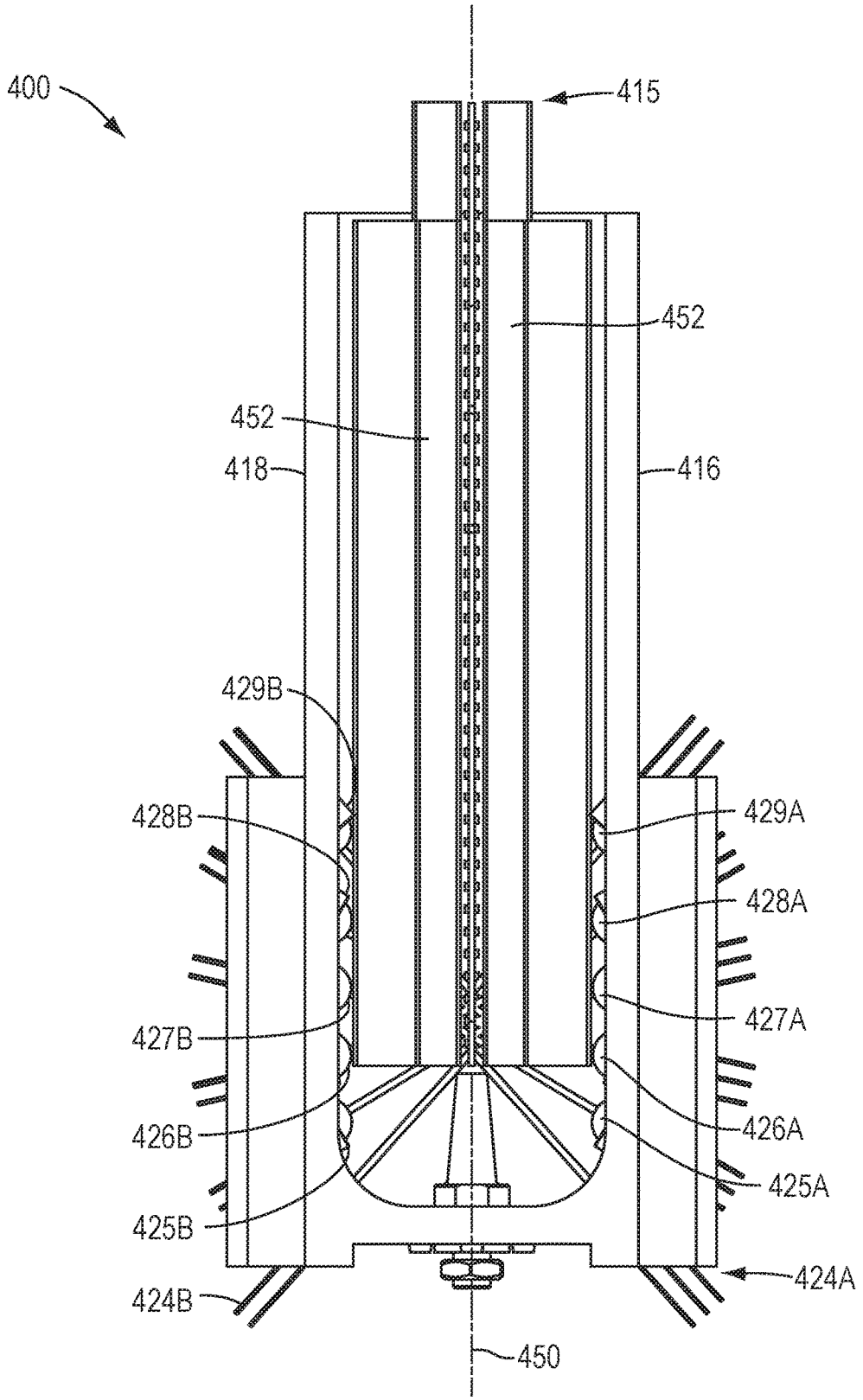
FIG. 4C is a cross-sectional top view of the PD device of FIG. 4A.

As illustrated in FIG. 4C, each LED 424A-429B has a directional component oriented transverse to the longitudinal axis 450 of the PD device 400 and the ion transport device 415 and longitudinal movement of ions, the movement of the ions being coextensive with the portion of the longitudinal axis 450 that extends from the front of the PD device 400 to the rear of the PD device 400 (see FIG. 4B, irradiation region 430). The respective directional components of each of the 424A-429B intersect at or proximate to the longitudinal axis 450 at an irradiation region 430. In operation, the LEDs can be selectively activated such that when the ions within the chamber are concentrated at or near the location of intersection, the aspects of the irradiation (e.g., wavelength, intensity, dispersion, etc.) can be varied over time at predetermined time intervals, such that the ion dissociation being initiated at each of the differing time intervals may be tailored for differing types of chemical bonds and/or differing types of chemical species.

Additionally, although not shown, it is further contemplated that, in some examples, the plurality of LEDs can comprise at least one LED or at least one pair of LEDs integrated within the back end wall 414. Additionally, each LED can include multiple radiation sources.

Figure 4D:
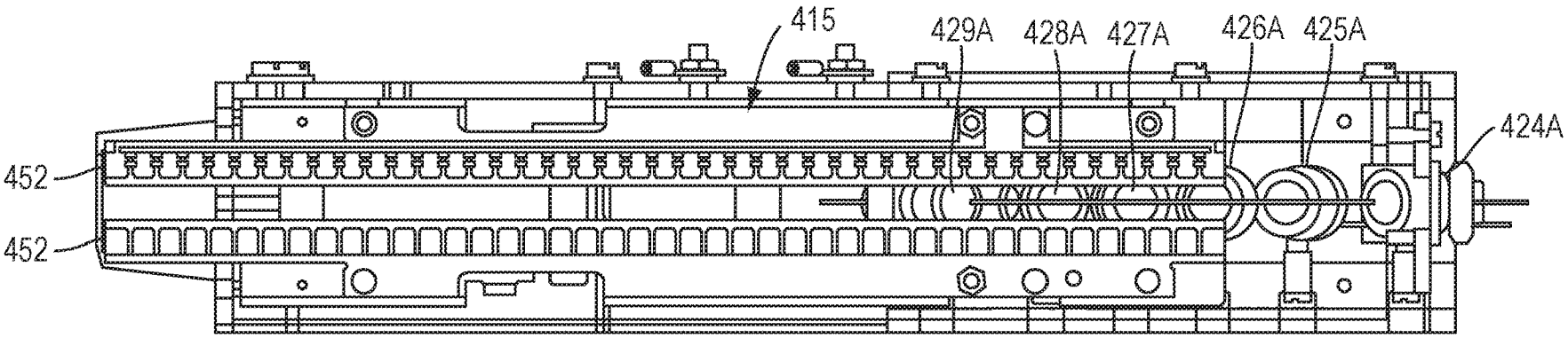
FIG. 4D is a cross-sectional side view of the PD device of FIG. 4A.

As illustrated in FIGS. 4C and 4D, the PD device 400 includes the ion transport device 415. The ion transport device 415 can include an electrode arrangement formed by a pair of PCBs 452 oriented such that a longitudinal length of each PCB is parallel to the longitudinal axis 450 of the chamber 404. Each PCB 140 extends longitudinally from approximately the first end 406 of the chamber 404 where the entry 413 is located. Also, each of the pair of PCBs 452 is disposed in alignment with one another on opposite longitudinal sides of the chamber 404. Alternatively, the pair of PCBs 452 can be replaced with the other various electrode arrangements disclosed herein. The ion transport device 415 is a multipole ion guide, such as, for example, a quadrupole ion guide having four elongated metal rods. The four rods of a quadrupole ion guide are arranged parallel to, and symmetrically around, the longitudinal axis 450 of the chamber 404. Each rod extends longitudinally from approximately the first end 406 of the chamber 404 where the entry 413 is located. Each PCB 452 and each quadrupole rod 150 extends longitudinally from approximately the first end 406 of the chamber 404 to approximately the second end 408. Alternatively, the ion transport device can consist of an array of ion guides or combination of ion guides, which can also include any means of generating and controlling an axial field for manipulation of the ion cloud.

Figure 4E:
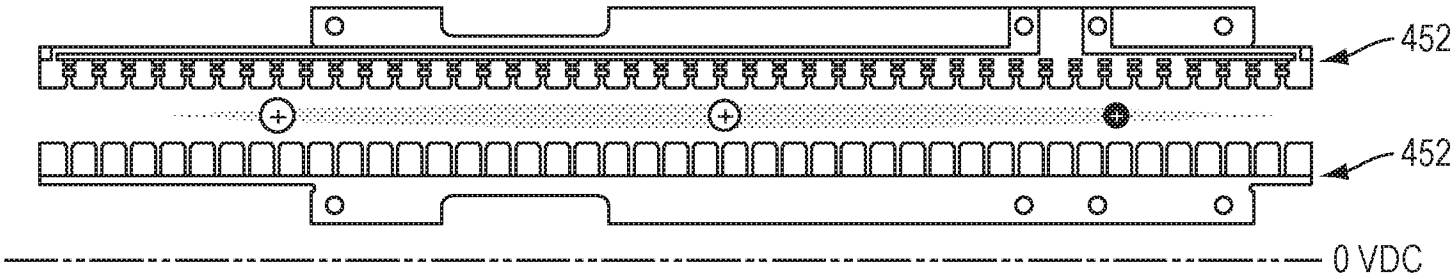
FIGS. 4E and 4F exemplary movement of ions in the PD device of FIG. 4A
Figure 4F:
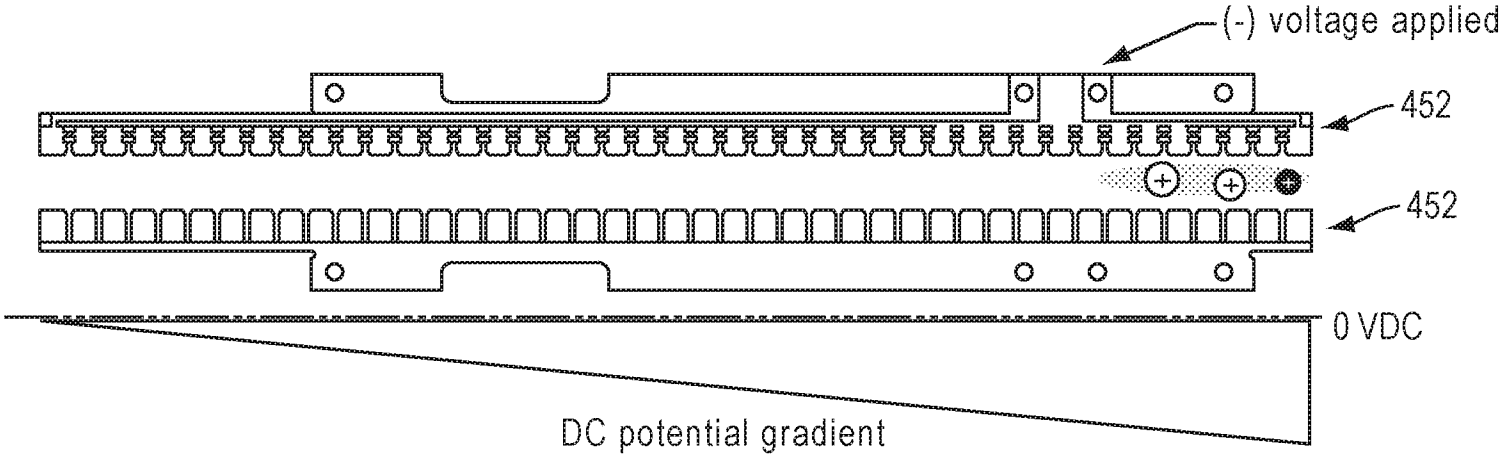

FIGS. 4E and 4F illustrate the process of transporting ions with the ion transport device 415. As illustrated in FIG. 4E, when no direct current (DC) voltage is applied to the PCBs 452, the ion will position within the ion transport device based on electrostatic forces between in the ions. As illustrated in FIG. 4F, when a DC potential gradient is applied, the ions will move to a desired position with the ion transport device 415, for example, the irradiation region 430.

Figure 5A:
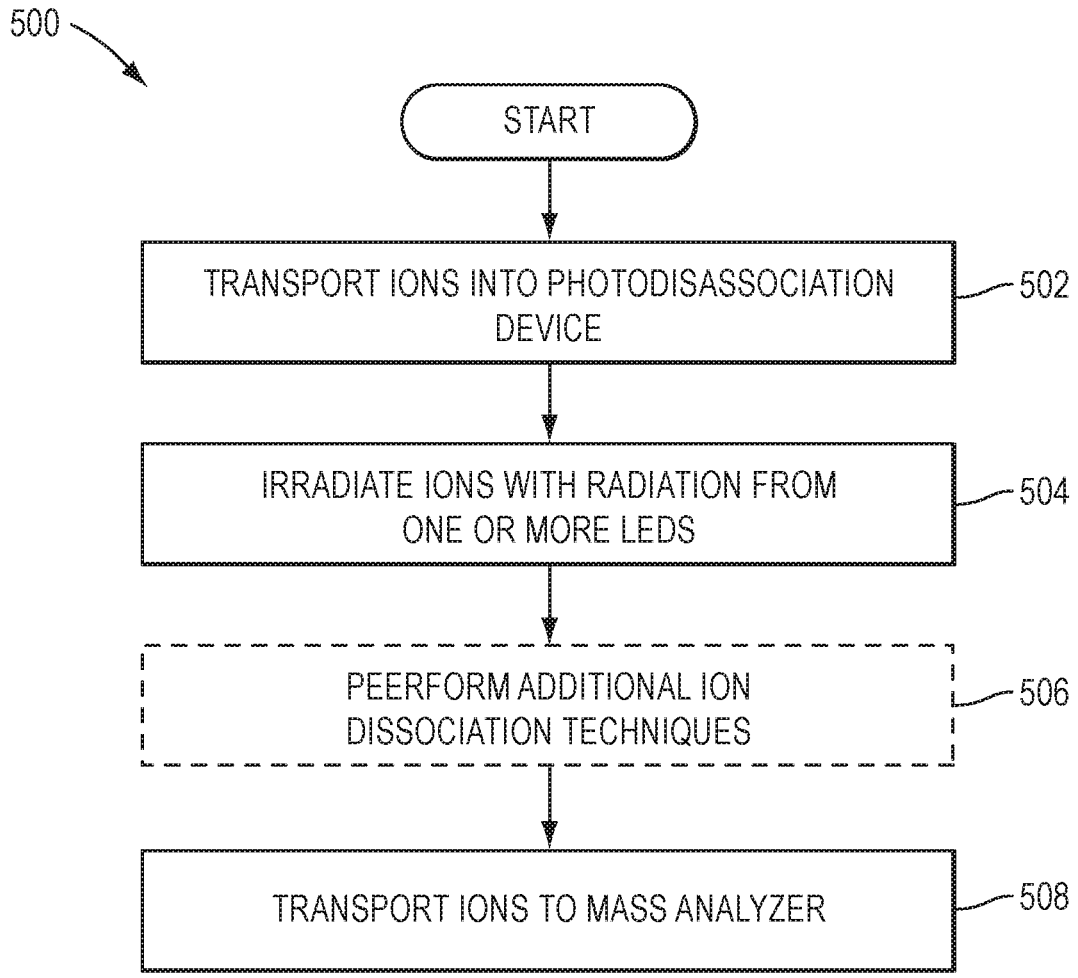
FIG. 5A depicts exemplary steps of a PD process for use in a mass spectrometer, according to embodiments of the present disclosure.

FIG. 5A illustrates an exemplary PD process 500 for use in a mass spectrometer, according to embodiments of the present disclosure. The process of FIG. 5 can be implemented in any mass spectrometer and PD device, for example, mass spectrometer 100 and PD device 102 described above. Although FIG. 5 depicts steps performed in a particular order for purposes of illustration and discussion, the operations discussed herein are not limited to any particular order or arrangement. One skilled in the art, using the disclosures provided herein, will appreciate that various steps of the methods can be omitted, rearranged, combined, added to, and/or adapted in various ways.

After the process begins, in 502, ions are transported to a PD device for dissociation or fragmentation. For example, referring to FIGS. 1A and 1B, the ions from the ion source 104 can be transported into the PD device 102 by the ion transport or containment device 108. For instance, the ion transport device can establish a potential gradient that causes the ions to move to the irradiation region 112 in the PD device 102.

In 504, the ions are irradiated with radiation from one or more LEDs. For example, referring to FIGS. 1A and 1B, one or more of the LEDs 110 can be energized to emit radiation directed at the irradiation region 112. The ions can be irradiated for a period of time. In some example, the ions can be irradiated with the same type of radiation (UV, IR, etc.) In some example, the ions can be irradiated with different types of radiation. In some examples, the ions can be irradiated with different patterns of radiation, for example, patterns illustrated in FIGS. 3A and 3B.

In 506, one or more additional dissociation techniques can optionally be performed. The one or more additional dissociation techniques can include ultraviolet photodissociation (UVPD), infrared multiphoton photo dissociation (IRMPD), electron-transfer dissociation (ETD), electron-capture dissociation (ECD), collision induced dissociation (CID), and high-energy collision dissociation (HCD). In some embodiments, the one or more additional dissociation techniques can be performed by additional dissociation systems. In some embodiments, the one or more additional dissociation techniques can be performed by the PD device 102.

In some embodiments, the one or more additional dissociation techniques can be performed after the irradiation by the LEDs. In some embodiments, the one or more dissociation techniques can be performed the irradiation by the LEDs. In some embodiments, the one or more additional dissociation techniques can be performed as an alternative to the irradiation by the LEDs.

In 508, the ions are transported to a mass analyzer. For example, referring to FIGS. 1A and 1B, the ion transport or containment device 108 can alter the potential gradient to cause the ions to move to the mass analyzer 106.

After, the process 500 can return to any point, repeat, or end. For example, the ions may need to undergo further dissociation or fragmentation or the process can be performed on new ions. In this example, the ion transport or containment device, for example, the ion transport or containment device 108 can transport the ions or new ions into the PD device, for example PD device 102.

Figure 5B:
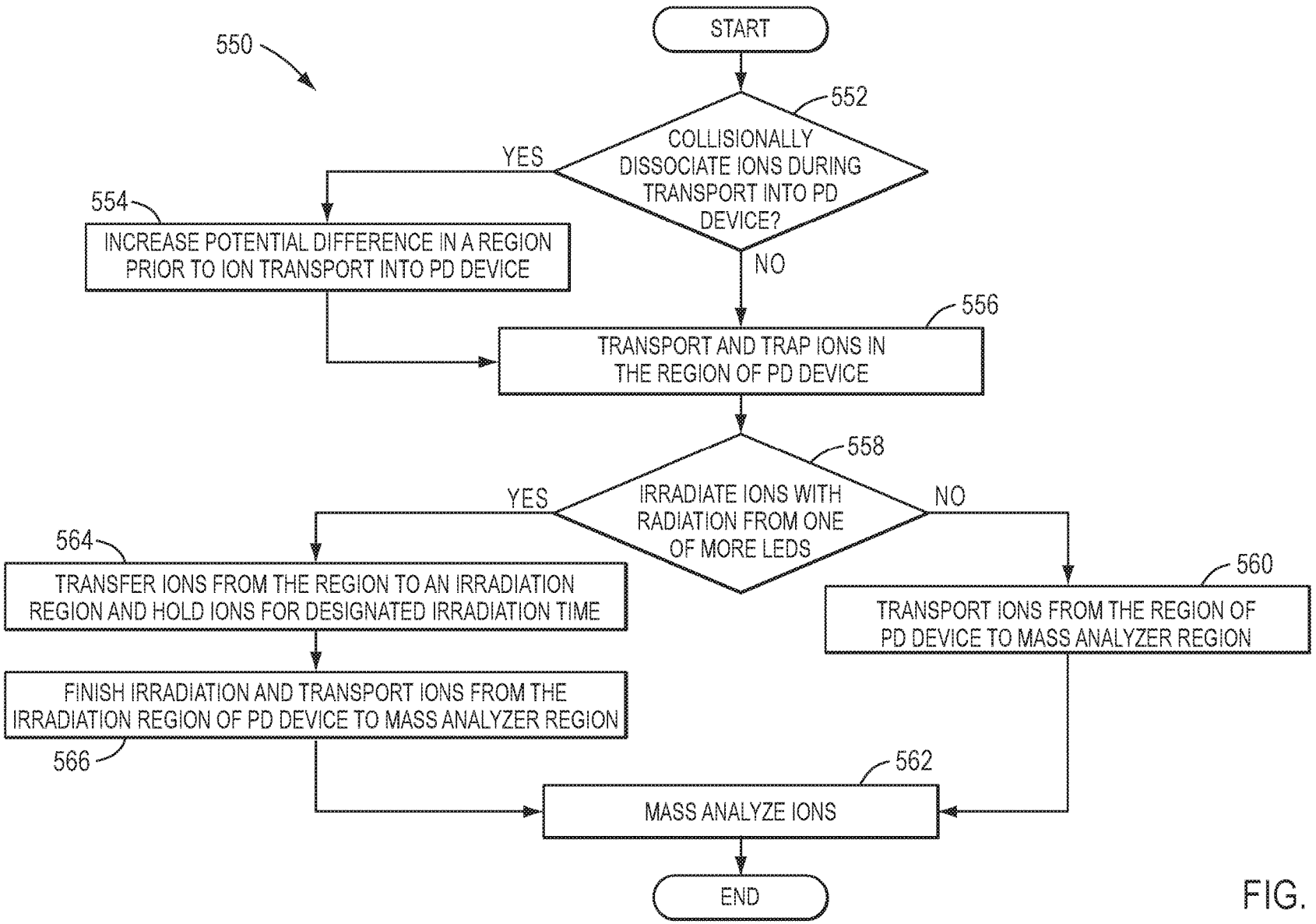
FIG. 5B depicts exemplary steps of another PD process for use in a mass spectrometer, according to embodiments of the present disclosure.

FIG. 5B illustrates another exemplary PD process 550 for use in a mass spectrometer, according to embodiments of the present disclosure. The process of FIG. 5B can be implemented in any mass spectrometer and PD device, for example, mass spectrometer 100 and PD device 102 described above. Although FIG. 5B depicts steps performed in a particular order for purposes of illustration and discussion, the operations discussed herein are not limited to any particular order or arrangement. One skilled in the art, using the disclosures provided herein, will appreciate that various steps of the methods can be omitted, rearranged, combined, added to, and/or adapted in various ways.

After the process begins, in 552, it is determined whether a collisionally dissociation is performed on ions being transported in the PD device. If the dissociation is performed, in 554, a potential difference in a region of the PD device is increased of the PD device prior to transport into the PD device. For example, referring to FIG. 2A, for example, the potential difference in region 230 can be increased relative to the regions 210 and 220.

In 556, after collisional dissociation or if the collisional dissociation is not performed, the ions are transported and trapped in the region of the PD device. For example, referring to FIG. 2A, the potential gradient in region 210 can be changed to cause the ions to collect in the region 230.

In 558, it is determined whether the ions are irradiated with radiation from one or more LEDs. If the ions are not irradiated, in 560, the ions are transported from the region of the PD device to a mass analyzer region. For example, the ions can be transported to the mass analyzer 106 by changing the potential gradient in the PD device 102 or 150. In 562, mass analysis is performed on the ions.

If the ions are irradiated, in 564, the ions are transferred from the region to an irradiation region and held for a designated irradiation time. For example, referring to FIG. 2A, the potential difference in irradiation region 112 can be changed relative to the region 230, thereby creating a potential gradient that causes the ions to move to the irradiation region 112.

In 566, the irradiation of the ions is finished and the ions are transported from the PD device to the mass analyzer region. For example, referring to FIGS. 1A and 1B, one or more of the LEDs 110 can be energized to emit radiation directed at the irradiation region 112. The ions can be irradiated for a period of time. In some example, the ions can be irradiated with the same type of radiation (UV, IR, etc.) In some example, the ions can be irradiated with different types of radiation. In some examples, the ions can be irradiated with different patterns of radiation, for example, patterns illustrated in FIGS. 3A and 3B. To transport the ions, for example, referring to FIG. 2A, the potential difference in irradiation region 112 can be changed relative to the regions 230 and 210, thereby creating a potential gradient that causes the ions to move out of the irradiation region 112.

In 562, mass analysis is performed on the ions. After, the process 500 can return to any point, repeat, or end. For example, the ions may need to undergo further dissociation or fragmentation or the process can be performed on new ions. In this example, the ion transport or containment device, for example, the ion transport or containment device 108 can transport the ions or new ions into the PD device, for example PD device 102.

EXAMPLES

The following examples are being presented to further illustrate the exemplary processes and devices of the present disclosure and are not intended to limit the examples of the embodiments described above.

Example 1

To demonstrate the utility of an ion photodissociation cell in accordance with the present disclosure, a model chemical specie, flavin mononucleotide (FMN), was processed using a PD device similar to PD device 400 in accordance with the present disclosure as described below. Fragment ions of m/z 243.2, 359.2, and 439.2 corresponding to losses of the side-chain, the phosphate group, and water, respectively, have been generated upon UVPD of protonated FMN, in addition to products of m/z 257.2 and 286.2 attributed to formation of lumiflavin and formyl-lumiflavin species, by a Q-ToF mass spectrometer equipped with a neodymium-doped yttrium aluminum garnet (Nd:YAG) laser for 266 nm UVPD, as disclosed at The Analyst, 139, 6348-6351 (2014) in the publication being titled "UV photodissociation of trapped ions following ion mobility separation in a Q-ToF mass spectrometer" by Barran et al., which is hereby incorporated by reference.

Figure 6:
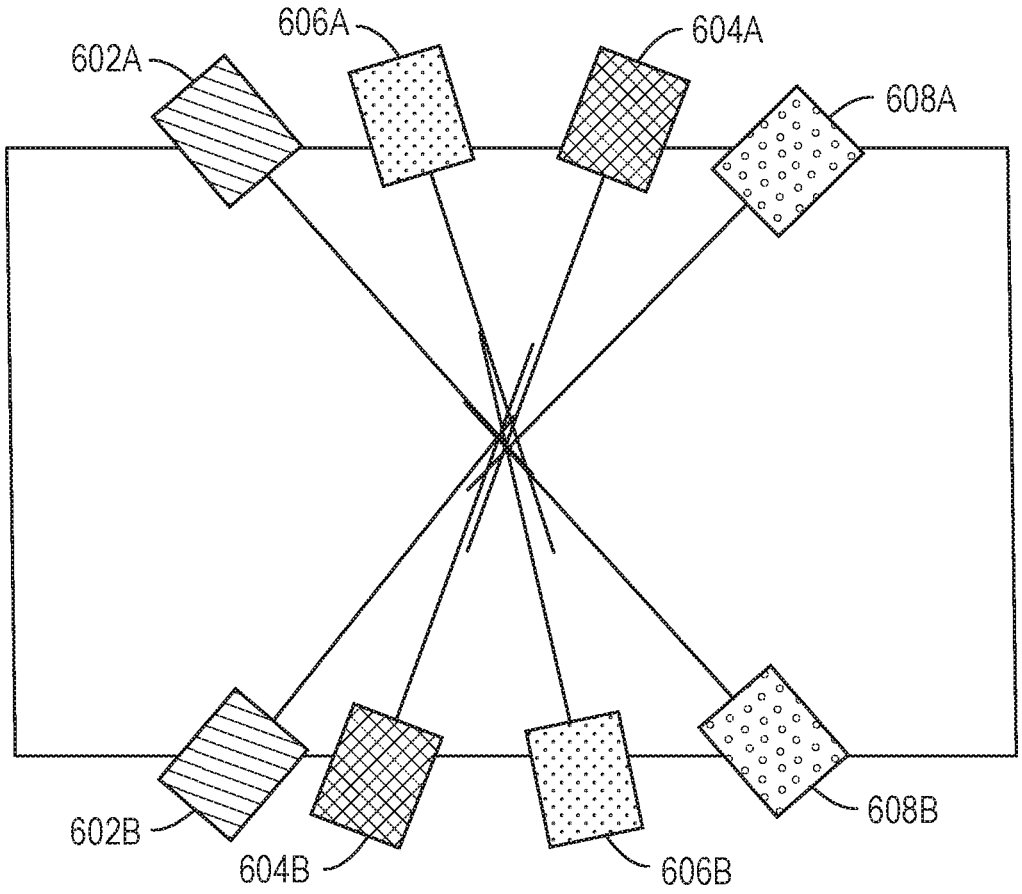
FIG. 6 is a diagrammatic representation of a configuration of LEDs for an exemplary PD device.

An experimental PD device 1, similar to PD device 400, was used to process FMN and was outfitted with eight LEDs. A schematic representation of the orientations of the LEDs 602A-608B of the experimental PD device 1 are shown in FIG. 6. A first pair of LEDs 602A and 602B emitted radiation at 275 nm, a second pair of LEDs 604A and 604B emitted radiation at 265 nm and first pattern (type #1), for example, the pattern illustrated in FIG. 3A, a third pair of LEDs 606A and 606B emitted radiation at 255 nm, and a fourth pair of LEDs 608A and 608B emitted radiation at 265 nm and a second patter (type #2), for example, the pattern illustrated in FIG. 3B.

Figure 7A:
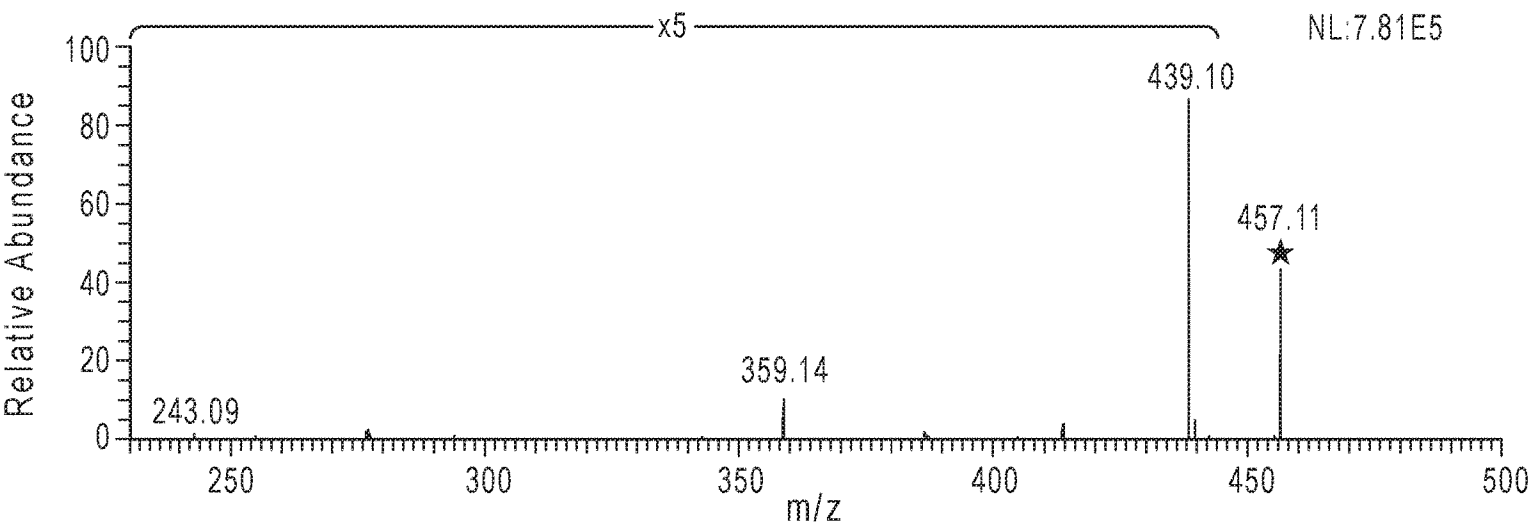
FIG. 7A shows various MS/MS spectra of protonated FMN produced by using a high-energy collision dissociation (HCD) process.
Figure 7B:
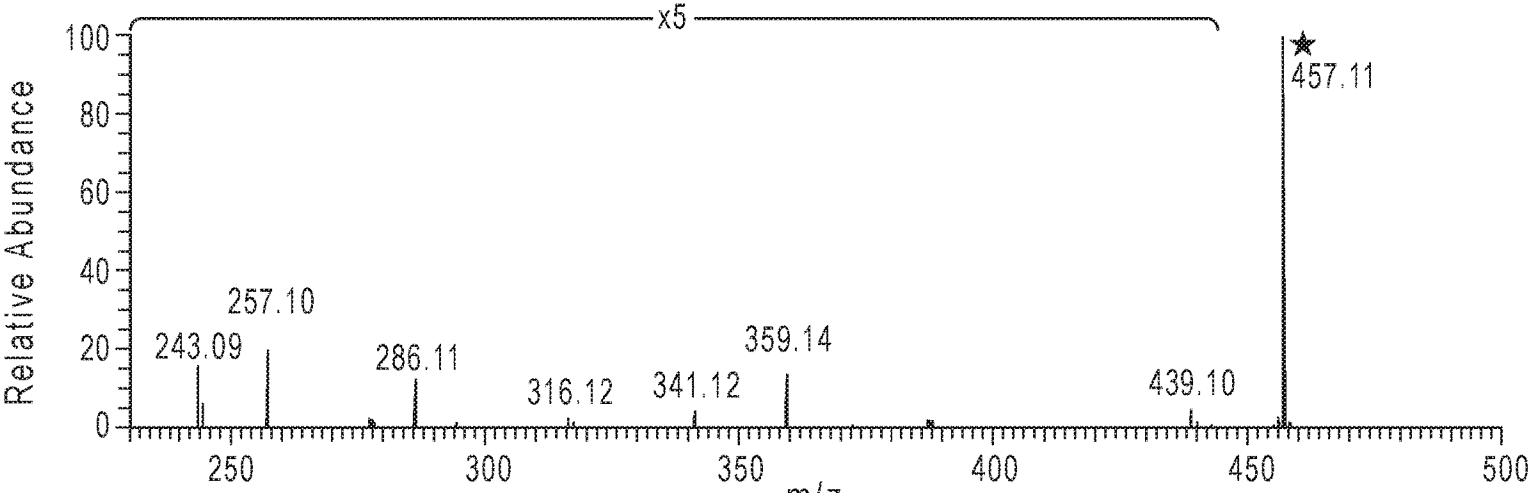
FIG. 7B shows various MS/MS spectra of protonated FMN produced by an exemplary PD device employing a PD process.
Figure 7C:
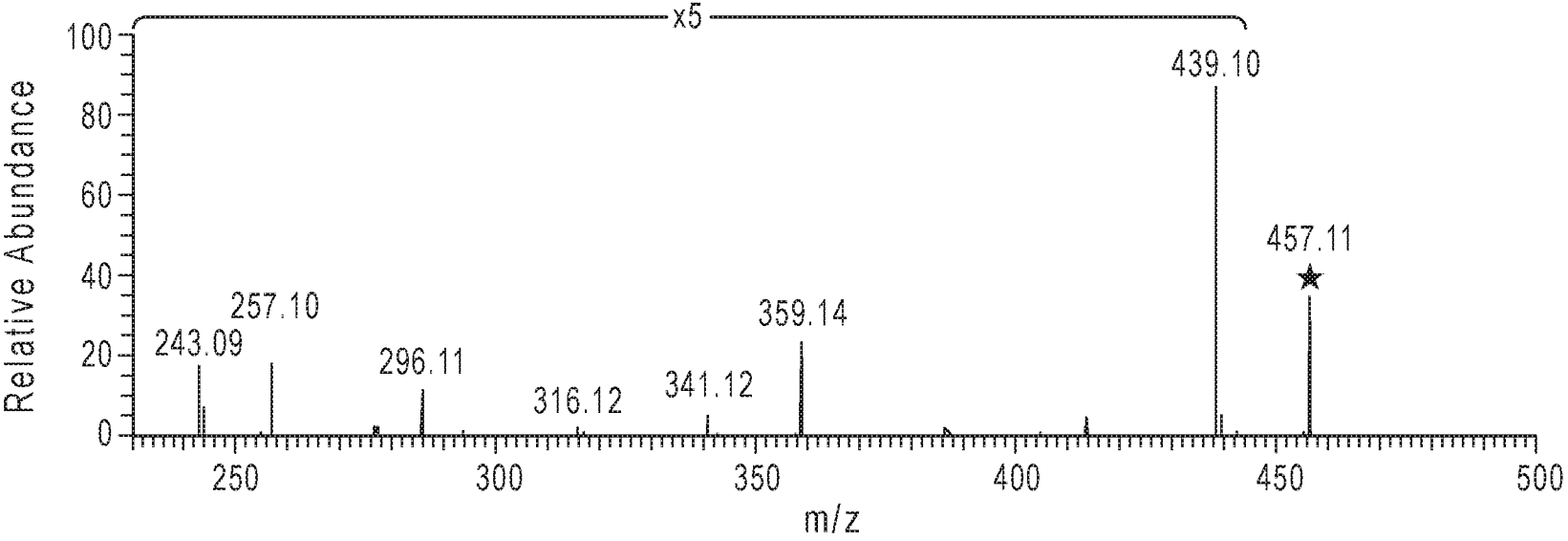
FIG. 7C shows various MS/MS spectra of protonated FMN produced by an exemplary PD device employing a PD process and a HCD process.

MS/MS spectra of protonated FMN using the experimental PD device 1 are shown in FIGS. 7A-7C. FIG. 7A shows an MS/MS spectra for protonated FMN subjected only to HCD in the experimental PD device 1 (i.e., no photodissociation was performed). HCD led to the formation of fragment ions of m/z 243.09, 359.14, and 439.10, which were all previously observed by Berran et al. (referenced above).

FIG. 7B shows an MS/MS spectra for protonated FMN subjected only to the ion transfer sequence and photodissociation process described above (i.e., no HCD was performed). During the photodissociation process, the protonated FMN ions were trapped and irradiated in the back end region of the LED-HCD device for a time period of 100 ms. Notably, as shown in FIG. 7B, the relative abundance of m/z 439.10 (water loss ion) was lower and the abundances of three key product ions (m/z 243.09, 257.10, and 286.11) were greater than the distribution observed upon HCD only (FIG. 7A).

FIG. 7C shows an MS/MS spectra for protonated FMN subjected to hybrid activation method that combined HCD with the previously described ion transfer sequence described above (100 ms irradiation time). In other words, the ions were irradiated with the LED radiation in combination with HCD, thereby capitalizing on the ability to augment fragmentation by using complementary activation methods within the LED-HCD photodissociation device.

Example 2

Figure 8A:
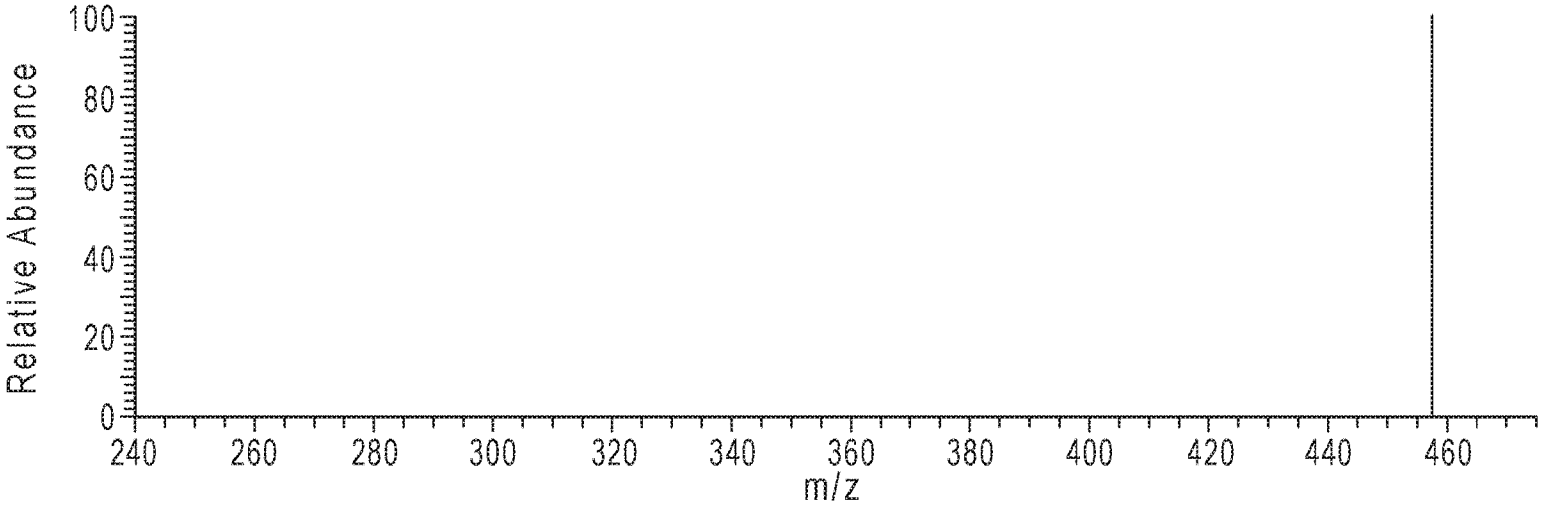
FIG. 8A shows various MS/MS spectra of protonated FMN produced by an exemplary PD device when ions are not present in an irradiation region.
Figure 8B:
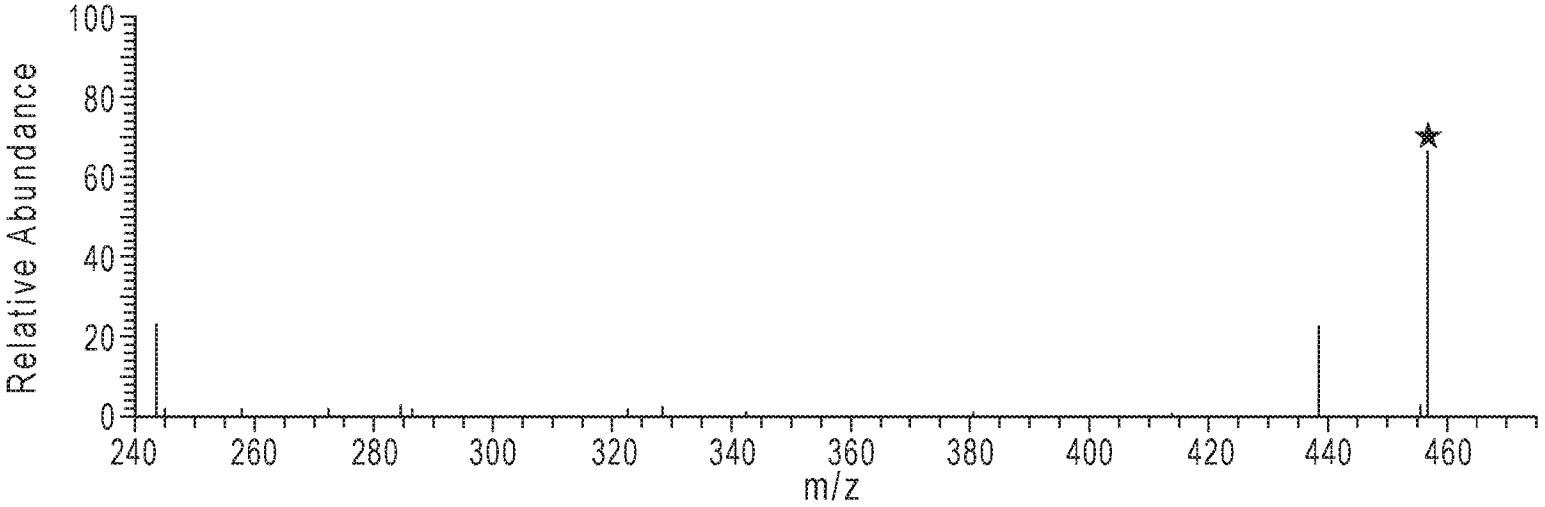
FIG. 8B shows various MS/MS spectra of protonated FMN produced by an exemplary PD device when ions are present in an irradiation region.

As a gauge of the level of control over ion position and UVPD in experimental PD device 1, similar to PD device 400 described above, the photodissociation of protonated FMN was evaluated based on the position of the ion cloud in the experimental PD device 1. First protonated FMN was transferred into the experimental PD device 1 and held proximate to the front end region of the chamber for 1000 ms while the LEDs were irradiating an irradiation region proximate to the back end of the chamber, for example, as illustrated in FIG. 2A-2 (See also FIGS. 2A-2C, FIGS. 4A-4F). No fragment ions were generated in the process, as illustrated in FIG. 8A. In a separate trial, protonated FMN was held proximate to the front end of the cell and then transferred to an irradiation zone proximate to the back end of the cell 300 where ions were exposed to UV-LED radiation for a time period of 1000 ms (FIG. 2A-3). Extensive fragmentation occurred once the ions were moved to the back of the cell during the LED irradiation period, as illustrated in FIG. 8B. Accordingly, it was shown that the ion guide mechanisms of the photodissociation device provided an effective level of control over ion confinement and positioning within the chamber.

Example 3

Figure 9A:
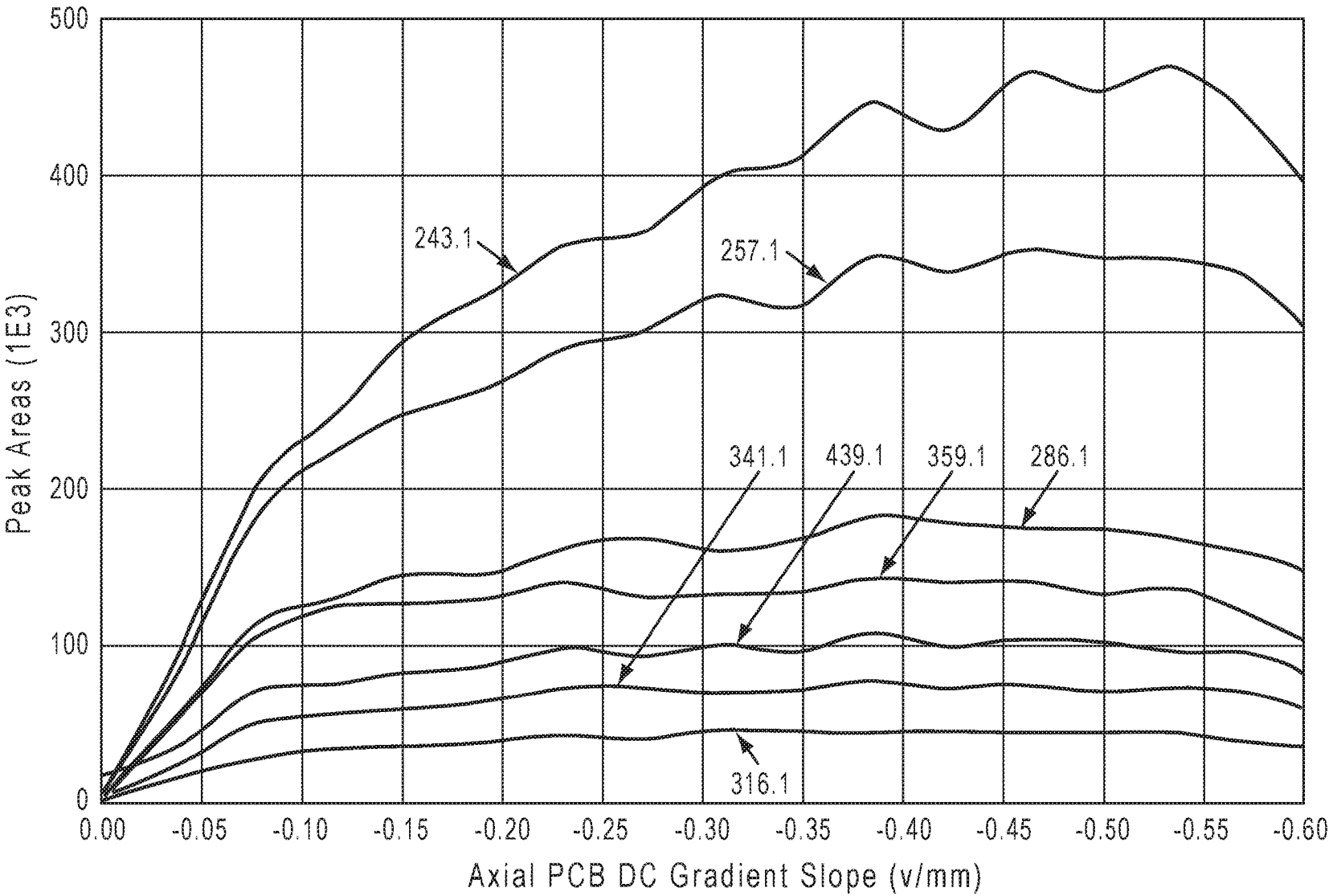
FIG. 9A shows the peak areas of fragment ions of various FMN spectra produced by analyzing ions processed in an exemplary PD device plotted as a function of the DC potential gradient slope.

To optimize the slope of the DC potential gradient during compression of the ion cloud proximate to the back end of the chamber of experimental PD device 1, several trials of UVPD of protonated FMN were performed using DC potential gradients at varying slopes and the resulting spectra were monitored. The radiation time was kept constant for all trials at 500 ms. FIG. 9A shows the abundance of fragment ions (peak areas) plotted as a function of the DC potential gradient slope (V/mm). As can be seen from FIG. 9A, the fragment ions of m/z 243, 257 and 286 exhibited the most dramatic increases in abundance as the potential slope was increased to about −0.46 V/mm Applying a slope greater than −0.46 V/mm caused a decrease in the production of fragment ions as well as a decrease in the precursor abundance (not shown), suggesting that ions were being ejected from the chamber.

Figure 9B:
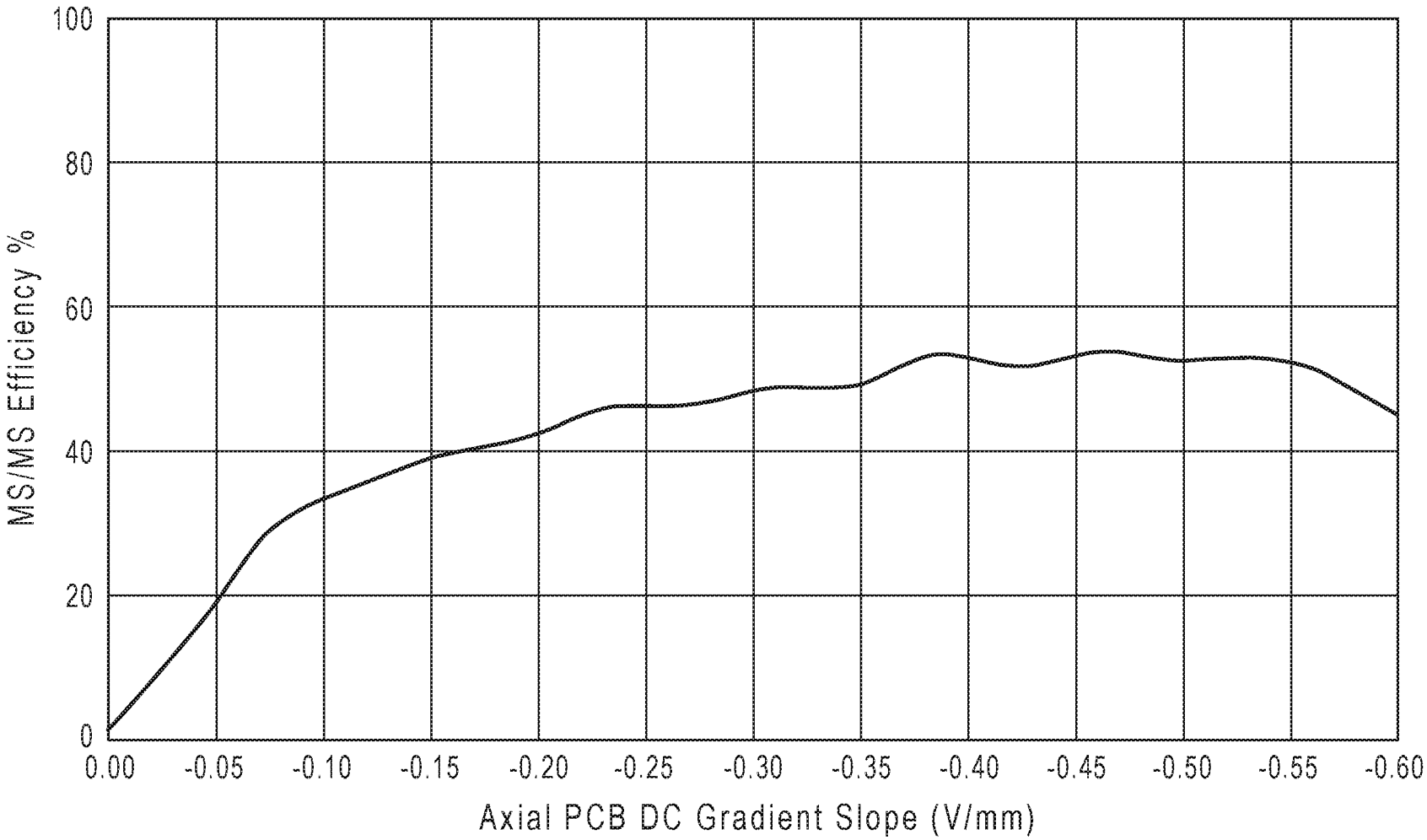
FIG. 9B shows MS/MS efficiencies of various FMN spectra produced by analyzing ions processed in an exemplary PD device plotted as a function of the DC potential gradient slope.

The results were further evaluated by observing how the MS/MS efficiency varied with the change in slope of the DC potential gradient. The MS/MS efficiency, defined as:

$$E_{MS/MS} = \frac{\sum_i F_i}{P_0} \times 100\%$$

where $E_{MS/MS}$ is MS/MS efficiency, $F_i$ is the summed abundances of all fragment ions, and $P_0$ is the abundance of the precursor ion prior to activation. MS/MS efficiencies are plotted in FIG. 9B as a function of the DC potential gradient slope (V/mm). As shown in FIG. 9B, an increase in MS/MS efficiency occurs as the slope increases from 0 and reaches an optimum efficiency of greater than 50%. Even in going from a slope of −0.15 to −0.46 V/mm, there is still an increase of 14% suggesting that there is an optimal overlap between the trapped ions and the photons when a steeper gradient slope is used to concentrate ions in a defined LED irradiation zone. However, at slopes greater than −0.46 V/mm, the efficiency declined somewhat, suggesting ions were being prematurely ejected from the chamber.

Example 4

To optimize irradiation time during compression of the ion cloud proximate to the back end of the chamber of the experimental PD device 1, several trials of UVPD of protonated FMN were performed using varying irradiation time periods and the resulting spectra were monitored. The slope of the DC potential gradient was kept constant for all trials at −0.46 V/mm.

Figure 10A:
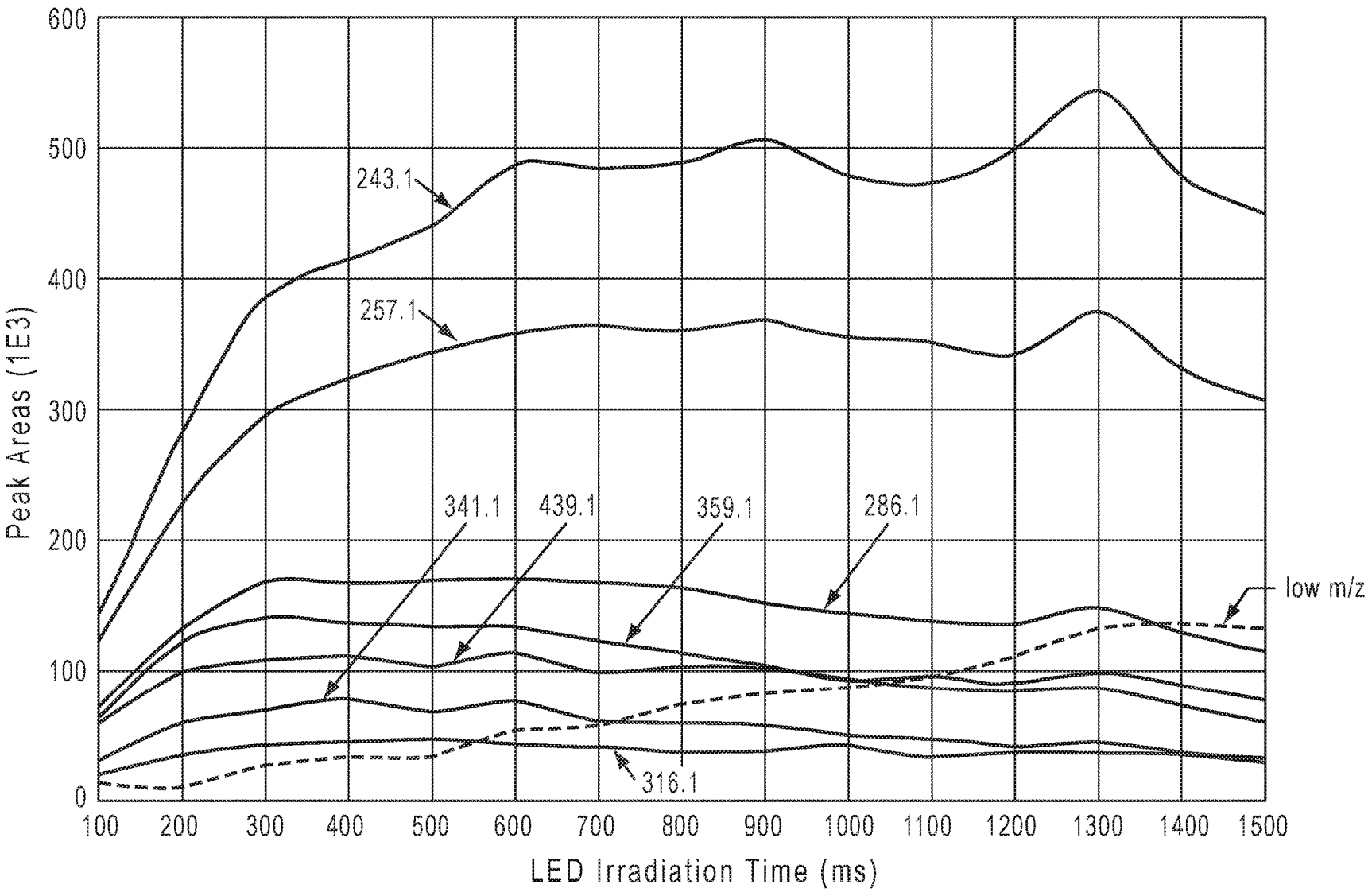
FIG. 10A shows the peak areas of fragment ions of various FMN spectra produced by analyzing ions processed in an exemplary PD device plotted as a function of the irradiation time.

FIG. 10A shows the abundance of fragment ions (peak areas) plotted as a function of the irradiation time (ms). As can be seen from FIG. 10A, the fragment ions of m/z 243 and 257 exhibited the most dramatic increases in abundance as irradiation time was increased. Under closer inspection, the abundances of some low mass fragment ions (m/z 172, 186, and 214) increased at longer irradiation times, suggesting the possibility of secondary fragmentation pathways at extended LED irradiation periods.

Figure 10B:
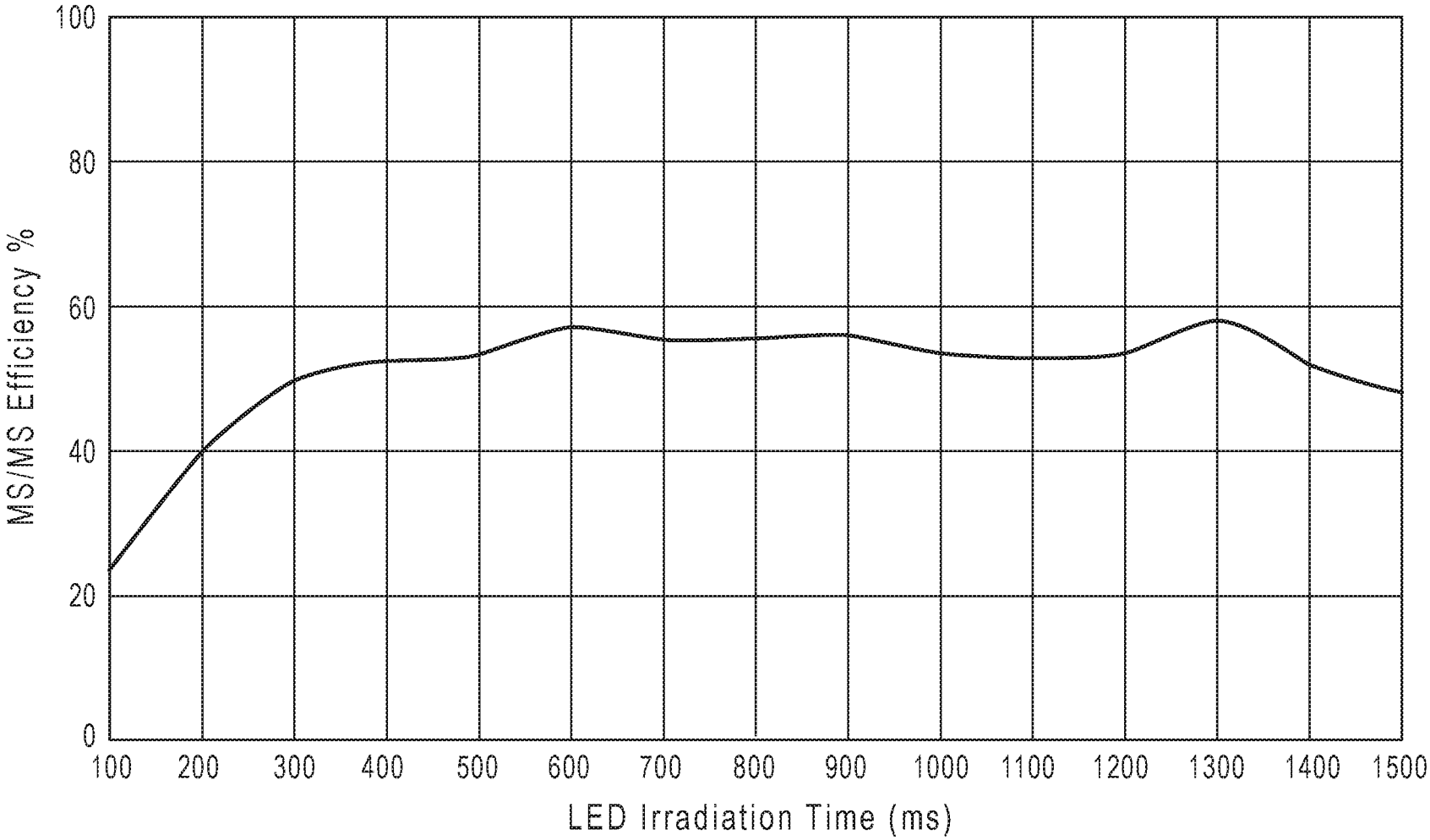
FIG. 10B shows MS/MS efficiencies of various FMN spectra produced by analyzing ions processed in an exemplary PD device plotted as a function of the irradiation time.
Figure 11:
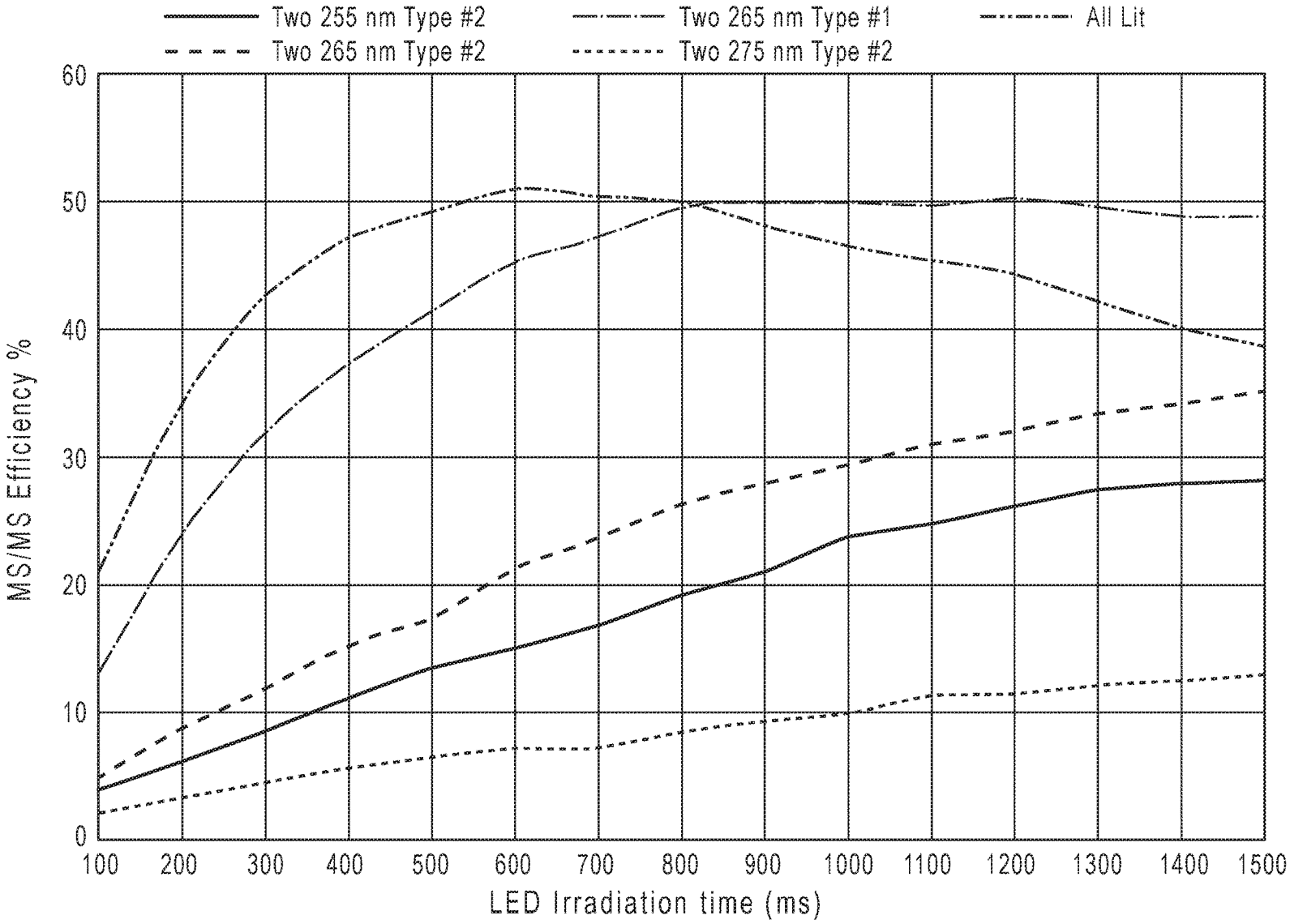
FIG. 11 shows MS/MS efficiencies of various FMN spectra produced by analyzing ions processed in an exemplary PD device via selective activation of various irradiation sources plotted as a function of the irradiation time.

MS/MS efficiencies were plotted in FIG. 10B as a function of the irradiation time (ms). As shown in FIG. 8B, the MS/MS efficiency increased up to an irradiation time of 500-600 ms and decreased beyond 650 ms. The overall MS/MS efficiency reached 57% at a 600 ms irradiation time.

Example 5

The effect of both the irradiation pattern of the LED and its wavelength on the fragmentation efficiency of FMN were also investigated. Two different types of irradiation patterns originate from the two different LED types used. (See FIGS. 3A and 3B.) Several combinations of irradiation pattern and LED wavelengths (255 nm, 265 nm, 275 nm) and their effects on MS/MS efficiencies were monitored and are shown in FIG. 10. The effect of the irradiation pattern can be seen by comparing the data for the two 265 nm wavelength LEDs which have type #1 (FIG. 3A) and type #2 (FIG. 3B) irradiation patterns. The more compact type #1 irradiation pattern gives higher efficiencies. The effect of the wavelength can be seen by comparing the data for the 255, 265, and 275 nm LEDs with type #2 irradiation patterns.

Example 6

Figure 12A:
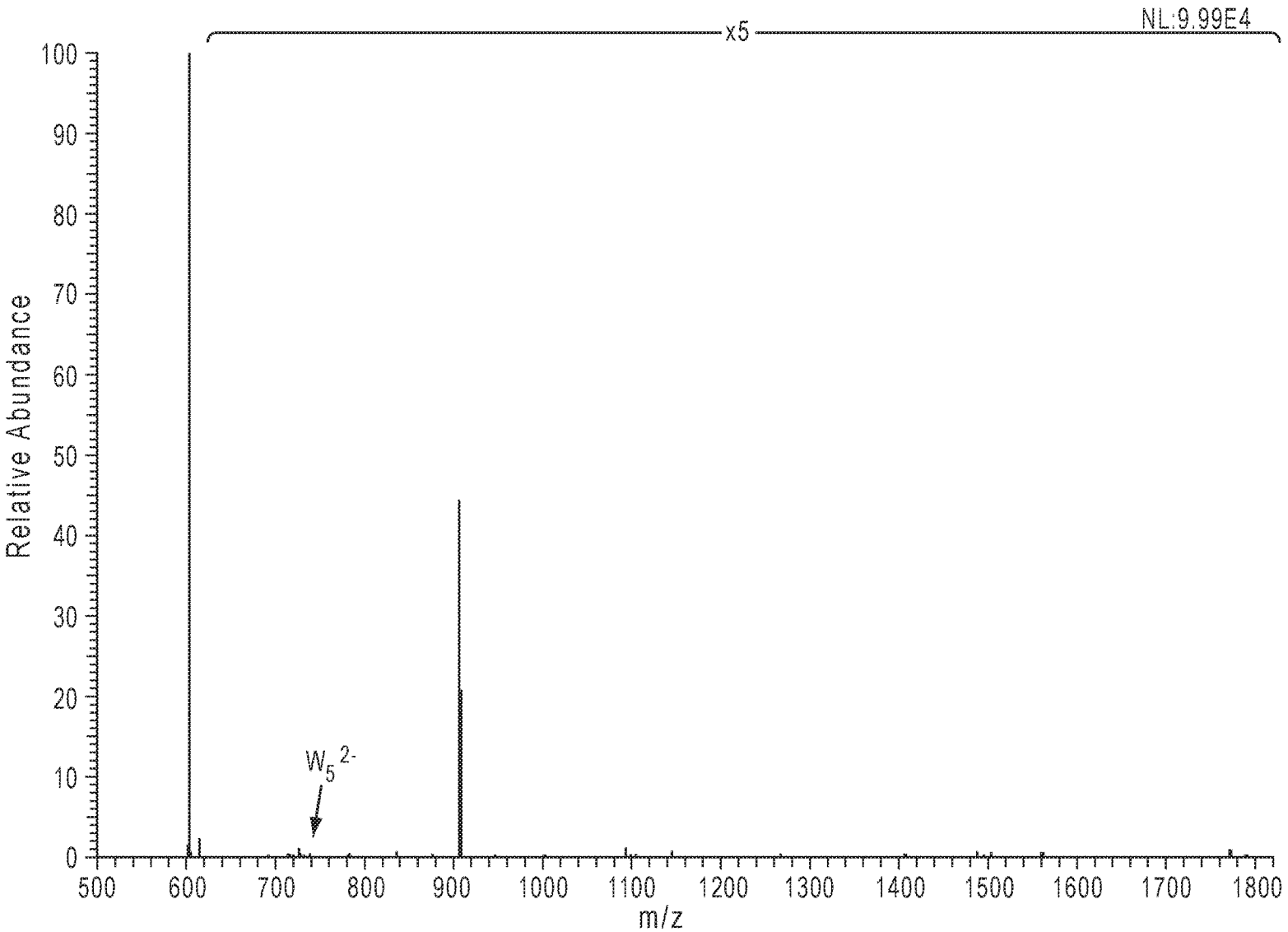
FIG. 12A-12C shows various MS/MS spectra of triply deprotonated 5'-GCGCGA-3' (an oligodeoxynuclotide) produced by using an exemplary PD device.
Figure 12B:
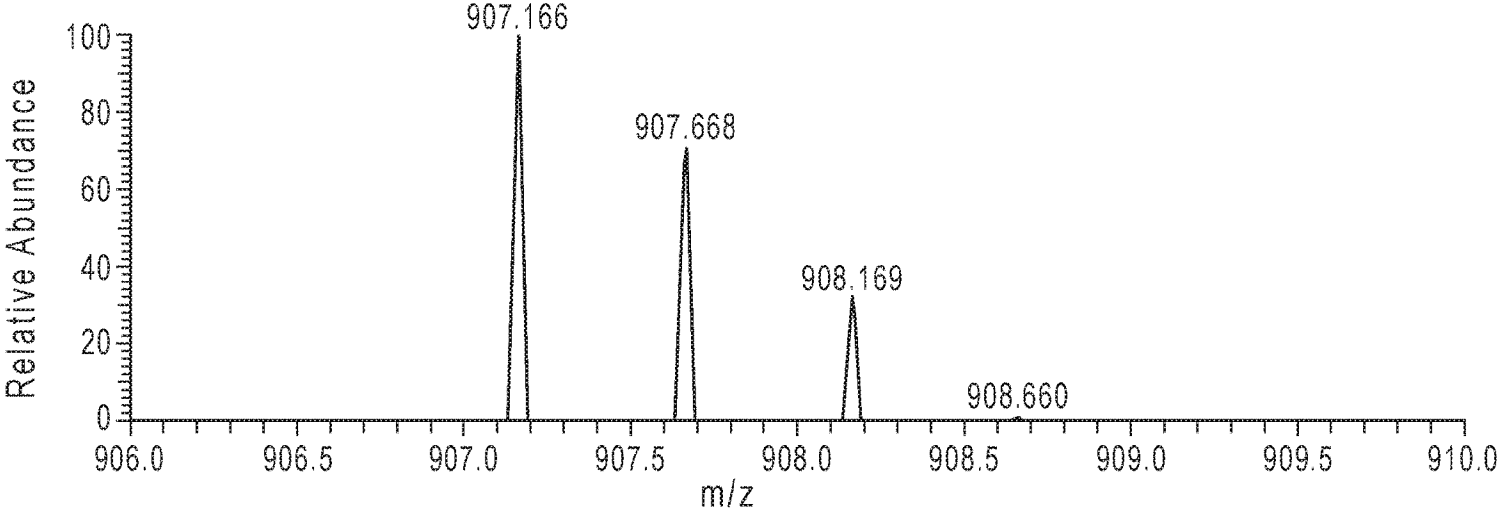
Figure 12C:
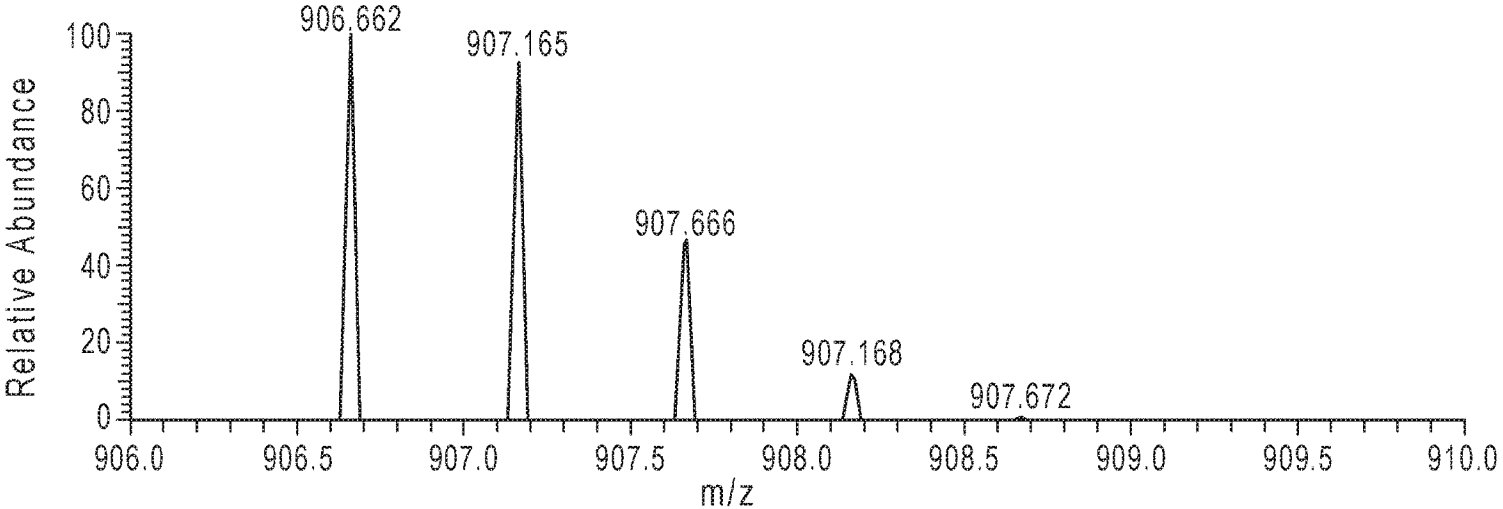

UVPD of negatively-charged ions can also be useful for analysis of many classes of compounds, including nucleic acids and glycopeptides. To test the negative mode functionality of the experimental LED UVPD device similar to PD device 400 described above, triply deprotonated 5'-GCGCGA-3' (an oligodeoxynuclotide) was trapped proximate to the back end of the chamber of experimental PD, as described above, and irradiated for 500 ms by all eight LEDs. The charge-reduced electron photodetachment ion was the dominant product, along with a minor $w_5$ fragment ion as shown in FIG. 12A. The identification of the electron photodetachment product was confirmed based on examination of its isotopic pattern Shown in FIG. 12C. The electron photodetachment product incorporates one more hydrogen atom than a typical doubly-deprotonated oligodeoxynucleotide created directly from ESI (FIG. 12B). These results demonstrate that performing UVPD with the experimental PD device results in the same electron photodetachment that is commonly observed upon 260-275 nm UVPD of DNA using a Nd:YAG laser.

This description and the accompanying drawings that illustrate exemplary embodiments should not be taken as limiting. Various mechanical, compositional, structural, electrical, and operational changes can be made without departing from the scope of this description and the claims, including equivalents. In some instances, well-known structures and techniques have not been shown or described in detail so as not to obscure the disclosure. Like numbers in two or more figures represent the same or similar elements. Furthermore, elements and their associated features that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

For the purposes of this specification and appended claims, unless otherwise indicated, all numbers expressing quantities, percentages, or proportions, and other numerical values used in the specification and claims, are to be understood as being modified in all instances by the term "about," to the extent they are not already so modified. Accordingly, unless indicated to the contrary, the numerical parameters set forth in the following specification and attached claims are approximations that may vary depending upon the desired properties sought to be obtained. At the very least, and not as an attempt to limit the application of the doctrine of equivalents to the scope of the claims, each numerical parameter should at least be construed in light of the number of reported significant digits and by applying ordinary rounding techniques.

While the teachings have been described with reference to examples of the embodiments thereof, those skilled in the art will be able to make various modifications to the described embodiments without departing from the true spirit and scope. The terms and descriptions used herein are set forth by way of illustration only and are not meant as limitations. It is noted that, as used in this specification and the appended claims, the singular forms "a," "an," and "the," and any singular use of any word, include plural referents unless expressly and unequivocally limited to one referent. In particular, although the processes have been described by examples, the stages of the processes can be performed in a different order than illustrated or simultaneously. Furthermore, to the extent that the terms "including", "includes", "having", "has", "with", or variants thereof are used in the detailed description, such terms are intended to be inclusive in a manner similar to the term "comprising." As used herein, the terms "one or more of" and "at least one of" with respect to a listing of items such as, for example, A and B, means A alone, B alone, or A and B. Further, unless specified otherwise, the term "set" should be interpreted as "one or more." Also, the term "couple" or "couples" is intended to mean either an indirect or direct connection. Thus, if a first device couples to a second device, that connection can be through a direct connection, or through an indirect connection via other devices, components, and connections.

This description's terminology is not intended to limit the invention. For example, spatially relative terms—such as "front", "back", "top", "bottom", "proximal", "distal", and the like—may be used to describe one element's or feature's relationship to another element or feature as illustrated in the figures. These spatially relative terms are intended to encompass different positions (i.e., locations) and orientations (i.e., rotational placements) of a device in use or operation in addition to the position and orientation shown in the figures. For example, if a device in the figures is turned over, elements described as "below" or "beneath" other elements or features would then be "above" or "over" the other elements or features. Thus, the exemplary term "below" can encompass both positions and orientations of above and below. A device may be otherwise oriented (rotated 90 degrees or at other orientations) and the spatially relative descriptors used herein interpreted accordingly.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. A mass spectrometer for ion dissociation, comprising:
an ion source;
a mass analyzer; and
a photodissociation (PD) device comprising:
a chamber comprising a first end, a second end opposite the first end, a first region proximate the first end, and a second region proximate the second end, and a longitudinal axis extending through the first and second ends, the chamber arranged to receive ions from the ion source at the first end,
an ion transport device configured to generate an electric field potential in the chamber,
a plurality of light emitting diodes (LEDs) positioned to transmit electromagnetic energy to and in an amount sufficient to cause fragmentation of one or more ions when located in the second region to form fragmented ions, wherein the plurality of LEDs are oriented to transmit the electromagnetic energy along respective paths extending in two or more intersecting directions that are angled relative to a direction of the longitudinal axis in the second region; and
a control system operably coupled to the ion transport device, the control system configured to adjust a strength and a gradient of the electric field potential generated by the ion transport device in the first and second regions of the chamber, and to manipulate longitudinal movement of the ions in the chamber, wherein:
in a first operational state, the control system is configured to control the electrical field potential to spatially concentrate ions in the second region for a time sufficient for fragmentation to occur, and
in a second operational state, the control system is configured to adjust a slope of the gradient of the electric field potential to move the ions longitudinally in the chamber from the first region to the second region.

2. The mass spectrometer of claim 1, wherein the ion transport device comprises one or more printed circuit boards (PCBs) configured to generate the electric field potential.

3. The mass spectrometer of claim 2, further comprising:
a direct current (DC) voltage source configured to apply a DC voltage to the one or more PCBs to generate the electric field potential.

4. The mass spectrometer of claim 1, wherein the control system is configured to adjust the slope to be in a range of about −0.1 volts/millimeter (V/mm) to about −0.5 V/mm.

5. The mass spectrometer of claim 1, wherein the control system is operably coupled to the plurality of LEDs and is further configured to adjust a time period of the transmission of electromagnetic energy by the plurality of LEDs.

6. The mass spectrometer of claim 1, wherein the control system is operably coupled to the plurality of LEDs and is further configured to adjust the plurality of LEDs to emit one or more continuous beams of light and pulsed beams of light.

7. The mass spectrometer of claim 1, wherein the plurality of LEDs comprise one or both of an ultraviolet LED and an infrared LED.

8. The mass spectrometer of claim 1, wherein the plurality of LEDs comprise one or more first LEDs that are configured to transmit the electromagnetic energy to the second region in a first pattern and one or more second LEDs that are configured to transmit the electromagnetic energy to the second region in a second pattern differing from the first pattern.

9. The mass spectrometer of claim 1, wherein photodissociation device is a first ion dissociation device, the mass spectrometer further comprising:
one or more additional ion dissociation devices, wherein the one or more additional ion dissociation devices are configured to perform one or more of ultraviolet photodissociation (UVPD), infrared multiphoton photo dissociation (IRMPD), electron-transfer dissociation (ETD), electron-capture dissociation (ECD), collision induced dissociation (CID), and high-energy collision dissociation (HCD).

10. A photodissociation (PD) device for use in a mass spectrometer, comprising:

a chamber comprising a first end, a second end opposite the first end, a first region proximate the first end, and a second region proximate the second end, and a longitudinal axis extending through the first and second ends;

an ion transport device configured to generate an electric field potential in the chamber;

plurality of light emitting diodes (LEDs) positioned to transmit electromagnetic energy to and in an amount sufficient to cause fragmentation of one or more ions when located in the second region to form fragmented ions, wherein the plurality of LEDs are oriented to transmit the electromagnetic energy along respective paths extending in two or more intersecting directions that are angled relative to a direction of the longitudinal axis in the second region; and a control system operably coupled to the ion transport device, the control system configured to adjust a strength and a gradient of the electric field potential generated by the ion transport device in the first and second regions of the chamber, and to manipulate longitudinal movement of the ions in the chamber, wherein:

in a first operational state, the control system is configured to control the electrical field potential to spatially concentrate ions in the second region for a time sufficient for fragmentation to occur, and in a second operational state, the control system is configured to adjust a slope of the gradient of the electric field potential to move the ions longitudinally in the chamber from the first region to the second region.

11. The PD device of claim 10, further comprising a voltage source configured to apply a voltage to the ion transport device to generate the electric field potential.

12. The PD device of claim 10, wherein the control system is operably coupled to the plurality of LEDs and is further configured to adjust the plurality of LEDs to emit one or more continuous beams of light and pulsed beams of light.

13. The PD device of claim 10, wherein the plurality of LEDs comprise one or both of an ultraviolet LED and an infrared LED.

14. The PD device of claim 10, wherein the plurality of LEDs comprise one or more first LEDs that are configured to transmit the electromagnetic energy to the second region in a first pattern and one or more second LEDs that are configured to transmit the electromagnetic energy to the second region in a second pattern.

15. A method of dissociating ions in a mass spectrometer using the photodissociation (PD) device of claim 10, the method comprising:

transporting ions from an ion source to the first region of the chamber, wherein the second region is downstream of the first region in a direction of transport of the ions from the ion source to the chamber;

performing a first dissociation technique on the ions located in the first region;

transporting the dissociated ions from the first region to the second region by adjusting the slope of the gradient of the electric field potential generated in the chamber; and subjecting the dissociated ions in the second region to the electromagnetic energy transmitted by the plurality of LEDs, resulting in fragmentation of the dissociated ions.

16. The method of claim 15, wherein the first dissociation technique comprises one or more of ultraviolet photodissociation (UVPD), infrared multiphoton photo dissociation (IRMPD), electron-transfer dissociation (ETD), electron-capture dissociation (ECD), collision induced dissociation (CID), and high-energy collision dissociation (HCD).

17. The method of claim 15, wherein the plurality of LEDs comprise one or more first LEDs that are configured to transmit the electromagnetic energy at a first wavelength and one or more second LEDs that are configured to transmit the electromagnetic energy at a second wavelength different from the first wavelength.

18. The method of claim 15, wherein the plurality of LEDs comprise one or more first LEDs that are configured to transmit the electromagnetic energy in a first pattern and one or more second LEDs that are configured to transmit the electromagnetic energy in a second pattern different from the first pattern.

19. The mass spectrometer of claim 1, wherein, in a third operational state, the control system is configured to adjust the slope of the gradient of the electric field potential to move the fragmented ions from the second region to the first region.

20. The mass spectrometer of claim 19, wherein the slope is inverted between the second and third operational states.

21. The mass spectrometer of claim 19, wherein in a fourth operational state, the control system is configured to control the electrical field potential to spatially concentrate the fragmented ions in the first region.

22. The mass spectrometer of claim 21, wherein the slope is inverted between the first and fourth operational states.

23. The PD device of claim 10, wherein, in a third operational state, the control system is configured to adjust the slope of the gradient of the electric field potential to move the fragmented ions from the second region to the first region.

24. The PD device of claim 23, wherein the slope is inverted between the second and third operational states.

25. The PD device of claim 23, wherein in a fourth operational state, the control system is configured to control the electrical field potential to spatially concentrate the fragmented ions in the first region.

26. The PD device of claim 25, wherein the slope is inverted between the first and fourth operational states.

* * * * *